US011998071B2

(12) United States Patent
Pezzimenti

(10) Patent No.: US 11,998,071 B2
(45) Date of Patent: Jun. 4, 2024

(54) VENTED GARMENT

(71) Applicant: NIKE, Inc., Beaverton, OR (US)

(72) Inventor: Luke A. Pezzimenti, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/843,684

(22) Filed: Jun. 17, 2022

(65) Prior Publication Data

US 2022/0322772 A1 Oct. 13, 2022

Related U.S. Application Data

(63) Continuation of application No. 15/254,749, filed on Sep. 1, 2016, now Pat. No. 11,406,148, which is a (Continued)

(51) Int. Cl.
*A41D 27/28* (2006.01)
*A41D 1/04* (2006.01)
(Continued)

(52) U.S. Cl.
CPC ..... *A41D 27/28* (2013.01); *A41D 1/04* (2013.01); *A41D 27/04* (2013.01); *A41D 31/125* (2019.02)

(58) Field of Classification Search
CPC ..... A41D 27/28; A41D 13/0025
(Continued)

(56) References Cited

U.S. PATENT DOCUMENTS 317,711 A 5/1885 Brinkmann
385,306 A 6/1888 Helwitz
(Continued)

FOREIGN PATENT DOCUMENTS

CN 2337793 Y 9/1999
CN 1864574 A 11/2006
(Continued)

OTHER PUBLICATIONS

Notice of Allowance received for U.S. Appl. No. 15/255,603, dated Sep. 30, 2022, 10 pages.
(Continued)

*Primary Examiner* — Timothy K Trieu
(74) *Attorney, Agent, or Firm* — Shook, Hardy & Bacon L.L.P.

(57) ABSTRACT

The technology described herein relates to vented and insulating garments having an interior garment assembly comprising an interior panel and a middle panel attached at one or more seams defining chambers for retaining thermally-insulating fill material. The seams have a first plurality of openings extending through the interior and middle panels. An exterior garment assembly has a second plurality of openings positioned on the exterior garment assembly such that the second plurality of openings are offset from the first plurality of openings when the exterior garment assembly is worn with the interior garment assembly. The offsetting of the openings may achieve moisture vapor or air transfer from the inside the garment to the outside environment. The exterior garment assembly and the interior garment assembly may be discrete garment pieces or may be attached at one or more locations.

20 Claims, 26 Drawing Sheets

Related U.S. Application Data continuation-in-part of application No. 14/877,199, filed on Oct. 7, 2015, now Pat. No. 10,111,480.

(51) Int. Cl.
*A41D 27/04* (2006.01)
*A41D 31/12* (2019.01)

(58) Field of Classification Search
USPC ..... 2/85
See application file for complete search history.

(56) References Cited

U.S. PATENT DOCUMENTS 1,252,187 A 1/1918 Shane
1,252,188 A 1/1918 Shane
1,612,010 A 12/1926 Gray
1,788,731 A 1/1931 Mishel
2,084,173 A 6/1937 Louis
2,121,836 A 6/1938 Steinberger
2,353,984 A 7/1944 Anthony
2,372,632 A 3/1945 Webb
2,385,124 A 9/1945 Anthony
2,464,380 A 3/1949 Daiber
2,466,911 A 4/1949 Raymond
2,540,547 A 2/1951 Rodert
2,781,820 A 2/1957 Stanley
2,851,390 A 9/1958 Chavannes
3,115,564 A 12/1963 Stacy
3,405,674 A 10/1968 Coates et al.
3,482,567 A 12/1969 Franklin
3,562,041 A 2/1971 Robertson
3,706,102 A 12/1972 Grenier
3,761,962 A 10/1973 Myers
3,771,170 A 11/1973 Leon
3,801,987 A 4/1974 Thompson
3,819,465 A 6/1974 Parsons et al.
3,852,144 A 12/1974 Parry
3,876,493 A 4/1975 Gilmore
4,039,709 A 8/1977 Newman
4,048,675 A 9/1977 Griffin
4,115,610 A 9/1978 Wortman
4,181,993 A 1/1980 Mcdaniel
4,185,327 A 1/1980 Markve
4,251,312 A 2/1981 Ziegler et al.
4,311,542 A 1/1982 Mueller et al.
4,370,754 A 2/1983 Donzis
4,396,039 A 8/1983 Klenk et al.
4,471,759 A 9/1984 Anderson et al.
4,496,407 A 1/1985 Lowery et al.
4,502,153 A 3/1985 Lapedes et al.
4,547,906 A 10/1985 Nishida et al.
4,560,427 A 12/1985 Flood
4,583,247 A 4/1986 Fingerhut et al.
4,603,069 A 7/1986 Haq et al.
4,604,152 A 8/1986 Liukko
4,608,715 A 9/1986 Miller et al.
4,610,750 A 9/1986 Mango
4,625,336 A 12/1986 Derderian
4,693,771 A 9/1987 Payet et al.
4,713,131 A 12/1987 Obeda
4,716,598 A 1/1988 Bertram
4,737,212 A 4/1988 Emrich et al.
4,756,937 A 7/1988 Mentzer
4,788,972 A 12/1988 Debusk
4,791,685 A 12/1988 Maibauer
4,938,817 A 7/1990 Langley
4,962,554 A 10/1990 Tesch
4,971,041 A 11/1990 Millikan et al.
5,001,783 A 3/1991 Grilliot et al.
5,003,902 A 4/1991 Benstock et al.
5,021,280 A 6/1991 Farnworth et al.
5,048,126 A 9/1991 Mclaughlin
5,067,178 A 11/1991 Katchka
5,131,097 A 7/1992 Grilliot et al.
5,150,476 A 9/1992 Statham et al.
5,165,115 A 11/1992 Stanislaw
5,168,576 A 12/1992 Krent et al.
5,201,075 A 4/1993 Svetich
5,255,392 A 10/1993 Stanislaw
5,267,519 A 12/1993 Uglene et al.
5,267,591 A 12/1993 Wakabayashi et al.
5,408,700 A 4/1995 Reuben et al.
5,445,863 A 8/1995 Slagle et al.
5,446,927 A 9/1995 Weldon
5,483,713 A 1/1996 Kikuchi et al.
5,526,534 A 6/1996 Lazar
5,545,128 A 8/1996 Hayes et al.
5,665,196 A 9/1997 Combe et al.
5,692,245 A 12/1997 Reuben
5,704,064 A 1/1998 Van
5,713,079 A * 2/1998 Simon ..... A41D 3/00 2/243.1
5,787,502 A 8/1998 Middleton
5,799,600 A 9/1998 Reuben
5,885,679 A 3/1999 Yasue et al.
5,924,134 A 7/1999 Taylor et al.
5,935,878 A 8/1999 Glasser
6,009,560 A 1/2000 Mckenney et al.
6,018,819 A 2/2000 King et al.
6,035,442 A 3/2000 Marando
6,038,700 A 3/2000 Aldridge et al.
6,049,908 A 4/2000 Bullock et al.
6,076,195 A 6/2000 Klein
6,076,196 A 6/2000 Masumoto
6,112,328 A 9/2000 Spector
6,182,297 B1 2/2001 Duren et al.
6,263,511 B1 7/2001 Polegato
6,279,161 B1 8/2001 Johnston
6,332,221 B1 12/2001 Gracey
6,339,843 B1 1/2002 Grilliot et al.
6,405,375 B1 6/2002 Sardi
6,427,242 B1 8/2002 Bush et al.
6,547,327 B1 4/2003 Yates
6,557,479 B2 5/2003 Alberts et al.
6,579,403 B2 6/2003 Tolbert et al.
6,632,501 B2 10/2003 Brownstein et al.
6,649,251 B1 11/2003 Druecke et al.
6,743,498 B2 6/2004 Fourmeux
6,805,181 B2 10/2004 Blundell et al.
6,808,791 B2 10/2004 Curro et al.
6,817,037 B1 11/2004 King
6,928,665 B1 8/2005 Yates
7,005,021 B2 2/2006 Kramer
7,017,191 B2 3/2006 Golde
7,037,569 B2 5/2006 Curro et al.
7,051,373 B1 5/2006 Krall
7,094,714 B2 8/2006 Li et al.
7,111,328 B2 9/2006 Bay
7,140,048 B2 11/2006 Wallerstein
7,147,911 B2 12/2006 Baychar
7,378,141 B2 5/2008 Polegato
7,437,774 B2 10/2008 Baron et al.
7,578,005 B2 8/2009 Vereen
7,757,311 B2 7/2010 Garneau
7,827,624 B1 11/2010 Cole
7,926,124 B2 4/2011 Hunter et al.
8,028,386 B2 10/2011 Rock et al.
8,057,878 B2 11/2011 Lo et al.
8,070,905 B2 12/2011 Brennan
8,127,701 B2 3/2012 Harward
8,133,824 B2 3/2012 Harber
8,377,536 B2 2/2013 Cienski
8,399,085 B2 3/2013 Moore et al.
8,458,819 B1 6/2013 Hoole
8,518,511 B2 8/2013 Harward
D693,095 S 11/2013 Grant
8,578,516 B2 11/2013 Li
8,756,714 B2 6/2014 Reimer
D713,620 S 9/2014 Pezzimenti et al.
D713,621 S 9/2014 Pezzimenti et al.
D714,022 S 9/2014 Mong et al.
8,828,167 B2 9/2014 Hannon
8,840,745 B2 9/2014 Green

(56) References Cited

U.S. PATENT DOCUMENTS

| | | | |
|---|---|---|---|
| 9,023,161 | B2 | 5/2015 | Ma et al. |
| 9,138,060 | B2 | 9/2015 | Vainberg et al. |
| 9,247,830 | B2 | 2/2016 | Waters et al. |
| 9,392,825 | B2 | 7/2016 | Pezzimenti et al. |
| 9,609,901 | B2 | 4/2017 | Nordstrom et al. |
| 9,881,093 | B2 | 1/2018 | Butler |
| 10,111,480 | B2 | 10/2018 | Pezzimenti |
| 10,362,820 | B2 | 7/2019 | Pezzimenti et al. |
| 10,694,797 | B2 | 6/2020 | Pezzimenti et al. |
| 10,842,211 | B2 | 11/2020 | Inoue et al. |
| 2002/0016122 | A1 | 2/2002 | Curro et al. |
| 2002/0022426 | A1 | 2/2002 | Curro et al. |
| 2002/0034912 | A1 | 3/2002 | Curro et al. |
| 2002/0034913 | A1 | 3/2002 | Curro et al. |
| 2002/0114918 | A1 | 8/2002 | Mossbeck et al. |
| 2002/0183671 | A1 | 12/2002 | Henderson et al. |
| 2003/0033656 | A1 | 2/2003 | Jaeger |
| 2003/0126673 | A1 | 7/2003 | Yardley |
| 2003/0138586 | A1 | 7/2003 | Fowler |
| 2003/0208831 | A1 | 11/2003 | Lazar et al. |
| 2004/0083538 | A1 | 5/2004 | Thomas |
| 2004/0111782 | A1 | 6/2004 | Lenormand et al. |
| 2004/0197534 | A1 | 10/2004 | Miller et al. |
| 2005/0124256 | A1 | 6/2005 | Mason et al. |
| 2005/0159056 | A1 | 7/2005 | Lap et al. |
| 2005/0249917 | A1 | 11/2005 | Trentacosta et al. |
| 2006/0059601 | A1 | 3/2006 | Opitz et al. |
| 2006/0135016 | A1 | 6/2006 | Iwasaki |
| 2006/0165939 | A1 | 7/2006 | Hottner |
| 2006/0185053 | A1 | 8/2006 | Wittmann et al. |
| 2006/0240234 | A1 | 10/2006 | Oneill et al. |
| 2007/0026186 | A1 | 2/2007 | Chapuis |
| 2007/0083985 | A1 | 4/2007 | Nathan et al. |
| 2007/0186832 | A1 | 8/2007 | Kishi et al. |
| 2007/0245448 | A1 | 10/2007 | Bury |
| 2007/0294800 | A1 | 12/2007 | Huang |
| 2008/0005823 | A1 | 1/2008 | Hung |
| 2008/0127395 | A1 | 6/2008 | Blauer et al. |
| 2008/0289078 | A1 | 11/2008 | Mather |
| 2008/0295216 | A1 | 12/2008 | Nordstrom et al. |
| 2009/0089911 | A1 | 4/2009 | Smith |
| 2009/0155543 | A1 | 6/2009 | Fowler |
| 2009/0233042 | A1 | 9/2009 | Sadato et al. |
| 2009/0314696 | A1* | 12/2009 | Trentacosta ..... G05D 23/19 210/97 |
| 2010/0030170 | A1 | 2/2010 | Keller et al. |
| 2010/0122394 | A1 | 5/2010 | Lambertz |
| 2010/0138977 | A1 | 6/2010 | Lin |
| 2010/0143669 | A1 | 6/2010 | Abrams |
| 2010/0281595 | A1 | 11/2010 | Gernes |
| 2010/0287680 | A1 | 11/2010 | Johnson et al. |
| 2010/0291825 | A1 | 11/2010 | Johnson et al. |
| 2011/0072558 | A1 | 3/2011 | Berns |
| 2011/0119811 | A1 | 5/2011 | Rock et al. |
| 2011/0125125 | A1 | 5/2011 | Schneider et al. |
| 2011/0296580 | A1 | 12/2011 | Demarest et al. |
| 2011/0302686 | A1 | 12/2011 | Chapuis |
| 2012/0005829 | A1 | 1/2012 | Waters et al. |
| 2012/0005831 | A1 | 1/2012 | Waters et al. |
| 2012/0017346 | A1 | 1/2012 | Reimer |
| 2012/0114883 | A1* | 5/2012 | Kapur ..... B32B 38/04 428/101 |
| 2012/0222189 | A1 | 9/2012 | Sokolowski et al. |
| 2012/0260396 | A1 | 10/2012 | Mordecai |
| 2012/0328824 | A1 | 12/2012 | Cartabbia |
| 2013/0014317 | A1 | 1/2013 | Ly |
| 2013/0031703 | A1 | 2/2013 | Curtis |
| 2013/0038104 | A1 | 2/2013 | Burns et al. |
| 2013/0061366 | A1 | 3/2013 | Pezzimenti |
| 2013/0177731 | A1* | 7/2013 | Moriarty ..... B32B 27/12 5/413 R |
| 2013/0255103 | A1 | 10/2013 | Dua et al. |
| 2013/0276201 | A1 | 10/2013 | Pezzimenti |
| 2013/0277349 | A1 | 10/2013 | Pezzimenti |
| 2014/0304896 | A1 | 10/2014 | Nordstrom et al. |
| 2014/0349057 | A1 | 11/2014 | Blackford et al. |
| 2015/0044943 | A1 | 2/2015 | Marshall et al. |
| 2016/0183613 | A1 | 6/2016 | Martin |
| 2016/0213077 | A1 | 7/2016 | Sung |
| 2016/0235147 | A1 | 8/2016 | Pezzimenti et al. |
| 2016/0278459 | A1 | 9/2016 | Hilty |
| 2016/0366962 | A1 | 12/2016 | Icheva et al. |
| 2016/0366963 | A1 | 12/2016 | Koshkaroff et al. |
| 2017/0028669 | A1 | 2/2017 | Regester et al. |
| 2017/0065005 | A1 | 3/2017 | Nordstrom |
| 2017/0099898 | A1 | 4/2017 | Pezzimenti |
| 2017/0099899 | A1 | 4/2017 | Pezzimenti et al. |
| 2017/0105467 | A1 | 4/2017 | Pezzimenti et al. |
| 2017/0245560 | A1 | 8/2017 | Pezzimenti et al. |
| 2018/0098584 | A1 | 4/2018 | Pezzimenti et al. |
| 2018/0098586 | A1 | 4/2018 | Pezzimenti et al. |
| 2018/0098588 | A1 | 4/2018 | Pezzimenti et al. |
| 2019/0289939 | A1 | 9/2019 | Pezzimenti et al. |
| 2019/0351094 | A1 | 11/2019 | Maher et al. |
| 2020/0000640 | A1 | 1/2020 | Mondal et al. |

FOREIGN PATENT DOCUMENTS

| | | | |
|---|---|---|---|
| CN | 2927724 | Y | 8/2007 |
| CN | 101209129 | A | 7/2008 |
| CN | 101731767 | A | 6/2010 |
| CN | 201782000 | U | 4/2011 |
| CN | 201929015 | U | 8/2011 |
| CN | 201999883 | U | 10/2011 |
| CN | 202122098 | U | 1/2012 |
| CN | 202233137 | U | 5/2012 |
| CN | 202293468 | U | 7/2012 |
| CN | 202368006 | U | 8/2012 |
| CN | 202375039 | U | 8/2012 |
| CN | 103358606 | A | 10/2013 |
| CN | 103750584 | A | 4/2014 |
| CN | 203969250 | U | 12/2014 |
| CN | 203986201 | U | 12/2014 |
| CN | 204132498 | U | 2/2015 |
| CN | 204340295 | U | 5/2015 |
| CN | 205072100 | U | 3/2016 |
| CN | 206182403 | U | 5/2017 |
| EP | 1325976 | A2 | 7/2003 |
| EP | 2617306 | A1 | 7/2013 |
| GB | 2256359 | A | 12/1992 |
| JP | 60-152630 | U | 10/1985 |
| JP | 2001-192901 | A | 7/2001 |
| JP | 2004211905 | A | 7/2004 |
| JP | 2005-226173 | A | 8/2005 |
| JP | 2013-129940 | A | 7/2013 |
| JP | 3185237 | U | 7/2013 |
| KR | 10-2009-0113413 | A | 11/2009 |
| KR | 20-0454066 | Y1 | 6/2011 |
| KR | 20-0455836 | Y1 | 9/2011 |
| WO | 2003/057975 | | 7/2003 |
| WO | 2004/082413 | A1 | 9/2004 |
| WO | 2013/070086 | A1 | 5/2013 |
| WO | 2014/062067 | A1 | 4/2014 |
| WO | 2014/087161 | A1 | 6/2014 |
| WO | 2017/062539 | A1 | 4/2017 |
| WO | 2018/046756 | A1 | 3/2018 |

OTHER PUBLICATIONS

Final Office Action received for U.S. Appl. No. 16/924,781, dated Nov. 1, 2022, 22 pages.

Non-Final Office Action received for U.S. Appl. No. 15/597,540, dated Nov. 23, 2022, 12 pages.

Notice of Allowance received for Canadian Patent Application No. 3,056,451, dated Nov. 8, 2022, 1 page.

Office Action received for Canadian Patent Application No. 3,125,031, dated Oct. 28, 2022, 4 pages.

Non-Final Office Action received for U.S. Appl. No. 15/597,540, dated Aug. 2, 2023, 16 pages.

Office Action received for European Patent Application No. 17765040.5, dated Jan. 24, 2023, 5 pages.

Office Action received for European Patent Application No. 17765042.1, dated Jan. 26, 2023, 5 pages.

(56) References Cited

OTHER PUBLICATIONS

Office Action received for European Patent Application No. 21163471.2, dated Jan. 24, 2023, 4 pages.
Non-Final Office Action received for U.S. Appl. No. 17/208,548, dated Dec. 14, 2022, 10 pages.
Final Office Action received for U.S. Appl. No. 15/597,540, dated Apr. 12, 2023, 15 pages.
Notice of Allowance received for U.S. Appl. No. 16/924,781, dated Mar. 23, 2023, 11 pages.
Notice of Allowance received for U.S. Appl. No. 17/208,548, dated Mar. 29, 2023, 10 pages.
Notice of Allowance received for Canadian Patent Application No. 3,125,031, dated Jun. 12, 2023, 1 page.
Final Office Action received for U.S. Appl. No. 15/597,540, dated Jun. 23, 2022, 15 pages.
Non-Final Office Action received for U.S. Appl. No. 18/083,930, dated Sep. 29, 2023, 13 pages.
Intention to Grant received for European Patent Application No. 18729254.5, dated Sep. 19, 2023, 7 pages.
78678 North End Sport Pursuit Ladies' 3-Layer Light Bonded Hybrid Soft Shell Jacket with Laser Perforation, Seasons Outfitters, Availble on Internet at: <http://www.seasonsoutfitters.com/index.php/outerwear-32/waterproof/78678-pursuit-ladies-3-layer-light-bonded-hybrid-soft-shell-jacket-with-laser-perforation.html>, Accessed on Jan. 23, 2015, 1 page.
88680: Ventilate—Men's Seam-Sealed Insulated Jacket, Alphabroder, Available on Internet at: <http://www.ashcity.com/en-ca/products/outerwear/insulated-seam-sealed/88680-ventilate-mens-nbsp-3bseam-sealed-insulated-jacket.html>, Accessed on Jan. 23, 2015, 2 pages.
Barbour Mens Chukka Quilted Jacket Military Brown Navy, Barbour, Available on Internet at: <http://www.coveredbridgecyclery.com/barbour-mens-chukka-quilted-jacket-military-brown-navy-1423.html>, Accessed on Jan. 23, 2015, 1 page.
C9 Loft Jacket, Houdini, Available on Internet at: <http://www.houdinisportswear.com/en/women/womens-c9-loft-jacket>, Accessed on Jan. 23, 2015, 1 page.
Greenland Baffled Jacket, Marmot For Life, Available on Internet at: <http://marmot.com/products/details/greenland-baffled-jacket>, Accessed on Jan. 23, 2015, 1 page.
Laser Perforated Jacket, Akris Punto, Nordstrom, Available on Internet at: <http://shop.nordstrom.com/s/akris-punto-laser-perforated-jacket/3667112>, Accessed on Jan. 23, 2015, 1 page.
Mavic Helium Jacket (Men's), MEC, Available on internet at: <http://www.mec.ca/product/5038-526/mavic-helium-jacket-mens/>, Accessed on Jan. 23, 2015, 1 page.
Nike Aeroloft, Nike, Available on Internet at: <http://www.nike.com/us/en_us/c/running/aeroloft>, Accessed on Jan. 23, 2015, 1 page.
Pizzoli' Knit & Quilted Jacket, Boss Hugo Boss, Nordstrom, Item #73989, Available on Internet at: <http://shop.nordstrom.com/s/boss-hugo-boss-pizzoli-knit-quilted-jacket/3782194>, Accessed on Jan. 23, 2015, 1 page.
Quilted Front Down Sweater Jacket, Moncler, Nordstrom, Item #803724, Available on Internet at: <http://shop.nordstrom.com/s/moncler-quilted-front-down-sweater-jacket/3900159>, Accessed on Jan. 23, 2015, 1 page.
Rab Microlight Alpine Down Jacket, backcountry, Item# RAB0244, Available on Internet at: http://www.backcountry.com/rab-microlight-alpine-down-jacketwomens?CMP_SKU=RAB0244&MER=0406&skid=RAB0244-ORC-USXLUS16&COUP=BUMP50&CMP_ID=PLA_GOc001&mv_pc=r101&utm_, Accessed on Jan. 23, 2015, 2 pages.
Salomon Men's S-Lab Hybrid Jacket, Running Warehouse, Model No. L36344900, Available on Internet at: <http://www.runningwarehouse.com/Salomon_Mens_S-Lab_Hybrid_Jacket/descpage-SMSLHJ.html>, 1 page.
Woman's Aconcagua Jacket, TheNorthFace,http://www.thenorthface.com/catalog/sc-gear/womens-jackets-vests/women-8217-s-aconcaguajacket.html?from=subCat&variationId=R8F &cm_mmc=Google-_-ProductlistingAds-_-ProductTerms-_ -The+North+Face+Women+s+Aconcagua+Jacket&gclid=Cj0KEQiAiuOIBRCU-,BD6idaPz_UBEiQAzTagNG1Cj7lahwV8b1m5IEh-Q2W_EcYDilCjgsF8EXvFMbEaApbd8P8HAQ, Accessed on Jan. 23, 2015, 1 page.
Women's Better than Naked™ Cool Jacket, The North Face, Available on Internet at: <http://www.thenorthface.com/catalog/sc-gear/women-39-s-better-than-naked-cool-jacket.html>, Accessed on Jan. 23, 2015, 1 page.
Women's Old Navy Active Front-Quilted Jackets, Old Navy, Aavilable on Internet at: <http://oldnavy.gap.com/browse/product.do?pid=172238002&vid=1&locale=en_US&kwid=1&sem=false&sdReferer=http%3A%2F%2Fwww.google.com%2Furl%3Fsa%3Dt%26rct%3Dj%26q%3D%26esrc%3Ds%26source%3Dweb%26cd%3D13%, Accessed on Jan. 23, 2015, 1 page.
Angie, "Trend: Quilted Textures", youlookfab, Available on Internet at: <http://youlookfab.com/2013/07/15/trend-quilted-textures/>, Jul. 15, 2013, 2 pages.
Bendzovski, Daniel, "Trend-sandwich: Exploring New Ways of Joining Inspiration, Such as Different Kinds of Trends, Through Processes of Morphing and Melding Different Trendy Garments and Materials, for New Methods, Garment Types, Materials and Expressions", MA Fashion Design Thesis, University of Boras, 2015, 224 pages.

* cited by examiner

VENTED GARMENT

CROSS-REFERENCE TO RELATED APPLICATIONS

This U.S. application Ser. No. 17/843,684, filed on Jun. 17, 2022, and entitled "Vented Garment," is a continuation application of U.S. application Ser. No. 15/254,749, filed Sep. 1, 2016, and entitled "Vented Garment," which issued as U.S. Pat. No. 11,406,148 on Aug. 9, 2022, which in turn is a continuation-in-part of U.S. application Ser. No. 14/877,199, filed Oct. 7, 2015, and entitled "Vented Garment," which issued as U.S. Pat. No. 10,111,480 on Oct. 30, 2018. The entireties of the aforementioned disclosures are incorporated by reference herein.

STATEMENT REGARDING FEDERALLY SPONSORED RESEARCH OR DEVELOPMENT

Not applicable.

TECHNICAL FIELD

Aspects of the technology described herein relate to a garment with vents that allow moisture vapor to exit the garment while still retaining heat from a wearer's body. More particularly, the technology described herein relates to breathable, insulating, cold-weather garments that keep the wearer warm and dry during cold-weather activities.

BACKGROUND

With the desire to stay active year round, there is a need for breathable, insulating garments for use during physical activity in the cold-weather months. Conventional cold-weather garments may not allow for moisture vapor from perspiration and/or sufficient body heat to escape from the inside of the garment. This is especially the case when the cold-weather garment includes insulation because the insulation may significantly reduce the moisture-vapor transmission rate through the garment. The trapping of moisture from perspiration may be particularly problematic for garments constructed from water-resistant fabrics. For instance, garments with fill material such as down or fibers are generally constructed of textiles that are resistant to the fill material penetrating the textile, either partially or entirely. Such fill-proof textiles may be created using treatments such as a durable water repellant (DWR) or by weaving or knitting a textile of sufficient weight to retain the fill material. Although these approaches often render the textile water-resistant, they may trap moisture vapor inside of the garment, which may then lead to discomfort for the wearer and may make the garment less effective as a cold-weather insulating garment.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The technology described herein generally relates to a vented garment that is insulating and breathable, which may facilitate the release of moisture vapor and heat from inside the garment. The vented garment in accordance with the technology described herein may be advantageous, for example, for a wearer undergoing physical exertion, such as aerobic activities (e.g., running, biking, hiking, snowboarding, skiing, etc.), physical labor, or other perspiration-inducing activities. When a person exercises, one possible physiological response is to cool down the body by releasing moisture in the form of perspiration. Perspiration still occurs in cold weather and might increase when a person wears heat-insulating garments. Therefore, an aspect of the technology described herein provides an insulating garment that may protect a wearer from external environmental conditions, while still allowing for moisture from perspiration to escape to the exterior environment. In addition, the technology may regulate an interior temperature of the garment by facilitating a transfer of heat through the garment.

The technology described herein allows moisture and/or heat to escape from the garment through a passage formed between, for instance, exterior and interior garment panels. In exemplary aspects, the interior garment panel may comprise an interior opening to the passage, and the exterior garment panel may comprise an exterior opening from the passage. Each passage may have multiple interior openings and exterior openings. And each garment may have multiple passages. The technology described herein offsets the interior openings from the exterior openings to provide an indirect passage for moisture vapor and/or air to exit the garment. In other words, the offset openings cause the moisture vapor to traverse the passage when exiting the garment instead of passing directly through the interior opening to the exterior opening. Moreover, the offset openings also cause heat produced by the body to traverse the passage prior to exiting the garment thereby preventing rapid heat loss. Thus, an object of the technology described herein is to facilitate moisture transport out of the garment while maintaining an appropriate amount of heat loss.

The insulating vented garment may be manufactured from a light-weight fabric and may comprise a number of insulating, down, or synthetic fiber-filled chambers, optionally separated by seams. In one aspect, the garment is woven or knit to comprise chambers created without seams. When seams are included in the garment, the seams separating the chambers may be spaced at varying intervals and may have any orientation and/or shape. In one example, the vented garment may be a standalone garment. The garment may be in the form of a vest covering a person's body core area, a jacket or coat with sleeves, pants, a total body suit, shirts, tights, base layers, and the like.

In one exemplary aspect, the seams may be formed by, for instance, actively adhering two panels (such as an interior and an exterior panel) of fabric together to form an exterior garment panel. The seams may be adhered together with, for example, a suitable adhesive tape material, by stitching or bonding the two panels of fabric together, or by both using the adhesive tape and stitching or bonding. In the case of certain fabrics, a tape may not be needed if the fabrics can be bonded without the use of tape.

In one example, interior openings may be formed in the interior panel at the seam area, exterior openings offset from the interior openings may be formed in the exterior panel at the seam area, and a passage may be formed connecting the interior openings with the exterior openings at the seam area. When the interior openings and exterior openings are both located in the seam area, then the seam may be formed by a method that does not seal the interior and exterior panels together within the seam area where the openings are located, such as by two parallel tracks of stitching or bonding thereby creating a passage that connects the interior openings to the exterior openings.

In another exemplary aspect, the insulating vented garment may comprise an additional interior panel that is affixed at one or more areas to an exterior garment panel having the chambers separated by seams. In this aspect, the interior openings may be formed in the additional interior panel and the exterior openings may be formed in the seam area between the chambers, where the interior openings are offset from the exterior openings. A passage is then formed in the space between the additional interior panel and the exterior garment panel having the chambers separated by the seams.

Additional objects, advantages, and novel features will be set forth in part in the description which follows, and in part will become apparent to those skilled in the art upon examination of the following, or may be learned by practice of the technology described herein.

BRIEF DESCRIPTION OF THE SEVERAL VIEWS OF THE DRAWING

The technology described herein is described in detail below with reference to the attached drawing figures, wherein.

DETAILED DESCRIPTION

Figure 1:
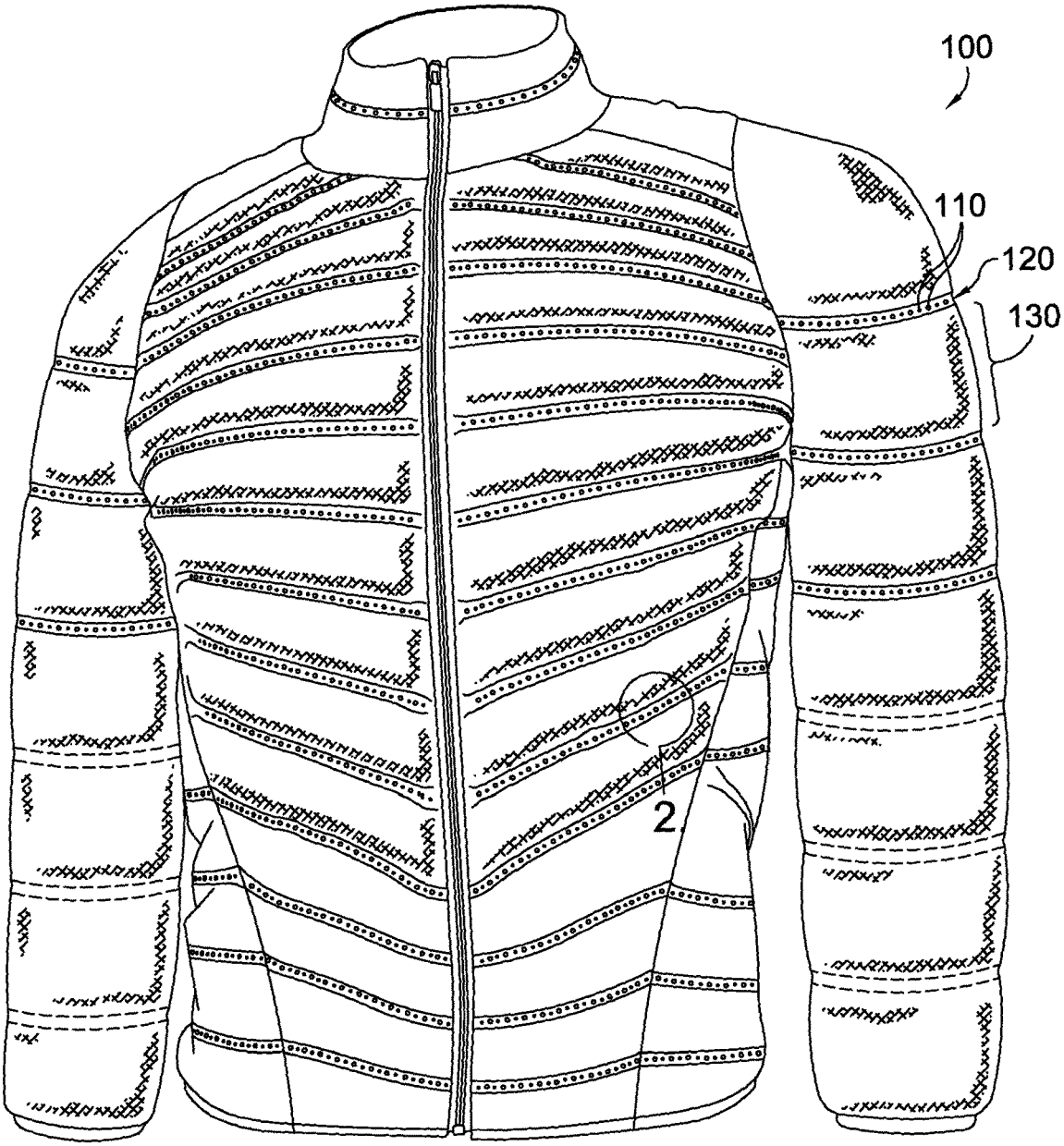
FIG. 1 is a view of an exemplary vented garment in accordance with the technology described herein.

The aspects described throughout this specification are intended in all respects to be illustrative rather than restrictive. Upon reading the present disclosure, alternative aspects will become apparent to ordinary skilled artisans that practice in areas relevant to the described aspects without departing from the scope of this disclosure. In addition, aspects of this technology are adapted to achieve certain features and possible advantages set forth throughout this disclosure, together with other advantages that are inherent. It will be understood that certain features and subcombinations are of utility and may be employed without reference to other features and subcombinations. This is contemplated by and is within the scope of the claims.

This technology is generally directed to a garment structure that facilitates the passive transfer of moisture and/or body heat from an internal portion of the garment to an external portion of the garment. For example, a garment may have an internal layer (e.g., interior panel) and an external layer (e.g., exterior garment panel), and aspects of the present technology are directed to transferring moisture vapor and/or heat from the internal layer to the external layer. The moisture vapor and/or heat can then dissipate or be dispersed into the space outside the garment.

In one instance of the present technology, one or more passages extend between the exterior and interior panels. In exemplary aspects, the interior panel comprises an interior opening, or inlet, to a passage, and the exterior panel comprises an exterior opening, or outlet, from the same passage. Each passage may have multiple interior openings and exterior openings. Each garment may have multiple passages.

In a further aspect, the technology described herein offsets the interior openings and the exterior openings to provide an indirect passage for moisture vapor and/or heat to pass from the interior panel to the exterior panel. In other words, the offset interior and exterior openings create passages that may include one or more changes in direction and that is not completely perpendicular to the respective planes of the interior panel and the exterior panel. The indirect passage may also provide resistance to air movement and moisture that helps regulate the amount of air and moisture leaving the garment. In one exemplary aspect, the materials of construction and the length of the indirect passages can be used in a garment to provide an appropriate amount of resistance to achieve the desired moisture and heat transmission. Thus, an object of the technology described herein is to facilitate moisture transport out of the garment while minimizing heat loss.

The interior and exterior openings may be positioned in various portions of the interior and exterior garment portions. For example, in one aspect the exterior openings are located in seam areas. The exterior openings might be created in seams using various techniques. For instance, after the seams are formed, the seams may then be perforated with a laser cutter, an ultrasonic cutting wheel, a water-jet cutter, a mechanical cutter, or the like to form the openings or perforations. With certain types of equipment, the affixing and perforating steps may be performed simultaneously, for example by using a welding and cutting wheel. The plurality of openings cut on the seams may be of different shapes and sizes and may create different patterns. The plurality of exterior openings may be continuous along the seams, or may be intermittently placed along the seams. In addition, the plurality of exterior openings may be placed strategically on seams located close to higher-perspiration areas (e.g., along the back of a wearer or under the arms of a wearer). The size and number of the plurality of exterior openings may be optimized to allow a desired level of ventilation, while still maintaining heat insulation close to the body of the wearer.

In one aspect of the technology, the interior openings to the passage are located in the seam area and/or on an additional interior panel that is affixed to an exterior garment panel having the seamed areas. In both instances, the interior openings are configured to be offset from the exterior openings. When the interior openings and exterior openings are both located in the seam area, then the seam may be formed by a method, such as, for example, two parallel tracks of stitching or bonding defining a passage between the tracks which does not fully seal the interior and exterior panels together at the seam. When the interior openings are located on the additional interior panel that is affixed to the exterior garment panel having the seamed areas, a passage may be formed in the space between the additional interior panel and the exterior garment panel having the seamed areas.

Materials of Construction

Vented garments in accordance with the technology described herein may be constructed using fabrics treated with down-proofing chemical treatments, and/or water repellants that may also act as down-proofing treatments, such chemical treatments referred to as DWR (durable water repellant). Although DWR is a waterproofing chemical treatment, in addition to waterproofing the fabric, it is also very useful for down-proofing fabrics, especially light and ultra-light weight fabrics. For example, fabrics that may particularly benefit from DWR treatment for down proofing are light fabrics (89 g/m$^2$ to 30 g/m$^2$) and ultra-light fabrics (29 g/m$^2$ or lighter). In some instances, down can have sharp shafts that can poke holes through light-weight fabrics, making the fabric more susceptible to tearing or down loss over time. Other types of fill material, such as polyester fibers, may lack the sharp shafts of down but are still challenging to contain within a light-weight textile. Heavier fabrics, such as fabrics with weights in the range of 90 g/m$^2$ to 149 g/m$^2$ or even 150 g/m$^2$ to 250 g/m$^2$ or higher, may be inherently more resistant to down and may or may not need a down-proofing treatment depending on the specific type of fabric/textile. Both heavy and light-weight fabrics may be used in garments in accordance with the technology described herein. Lighter weight fabrics may be more desirable in the manufacture of athletic and/or high aerobic activity insulating garments to minimize the garment weight.

In exemplary aspects, the insulating garment may be manufactured from a light-weight fabric and may comprise a number of insulating, down, or synthetic fiber-filled chambers, separated by seams. Seams separating chambers may be located at various areas of the garment, spaced at varying intervals, and may have any orientation and/or shape. The seams may be formed by actively adhering an exterior or outer panel and an interior or inner panel of fabric together with a suitable adhesive tape material to form an exterior garment panel, by stitching the two panels of fabric together, or by both using the adhesive tape and stitching. In the case of certain fabrics, a tape may not be needed if the fabrics can be bonded without the use of tape.

In one aspect, one or more portions of the insulating zones and/or the vented garment may be constructed using a weaving or knitting process (e.g., a weaving or knitting machine may be programmed to form various structures or constructions described herein). For example, such weaving or knitting processes may be used to form a seamless or nearly seamless garment or portions thereof.

Form Factor

The vented insulated garment described herein can take several forms. In one example of the garment in accordance with the technology described herein, the garment may be a standalone garment. The garment may be in the form of a vest covering a person's body core area, a jacket or coat with sleeves, pants, a total body suit, ski pants, a fleece, a clothing liner, and the like.

Alternatively, the garment in accordance with the technology described herein may be used as a removable interior-insulating panel having an exterior shell that may or may not be weather proof. This interior-insulating panel may also be worn as a standalone garment when detached from the exterior shell. Like in the previous example, the removable interior-insulating panel may be presented as a vest, a jacket, a body suit, and the like, depending on the type of garment and protection desired. For example, if the exterior shell is a long sleeved jacket, the interior-insulating panel may be presented as a vest, a jacket, or a jacket with removable sleeves to convert into a vest, depending on the amount of insulation desired. The interior-insulating panel may be fastened to the exterior shell by a zipper mechanism, buttons, hook-and-loop fasteners, or other suitable fastening mechanism or combination of fastening mechanisms.

Further, the vented garment may be engineered into an exterior shell. In other words, instead of being removable, an interior insulating and breathable panel in accordance with the technology described herein may be permanently attached to the exterior shell. This may be achieved by permanently affixing the exterior shell to the interior insulating and breathable panel at one or more areas using, for instance, stitching, bonding, welding, adhesives, and the like. Alternatively, an interior insulating and breathable panel may be integrated into an exterior shell panel by, for instance, integrally forming the interior insulating and breathable panel with the exterior shell using an engineered knitting and/or weaving process. Any and all aspects, and any variation thereof, are contemplated as being within the scope herein.

Definitions

Exterior garment assembly: As used herein, the phrase "exterior garment assembly" describes an assembly of one or more panels positioned on the exterior of the garment.

Exterior panel: As used herein, the phrase "exterior panel" describes a panel on the exterior of the garment. The exterior panel may be exposed to the external environment or may not be exposed to the environment, for example, if the garment is worn under another garment or layer. The exterior panel itself may comprise one or more layers of panels.

Exterior opening: As used herein, the phrase "exterior opening" describes an opening in the exterior panel or in the one or more panels forming the exterior garment assembly.

Interior garment assembly: As used herein, the phrase "interior garment assembly" describes an assembly of one or more panels that are inside of or interior to the exterior garment assembly.

Interior panel: As used herein, the phrase "interior panel" describes a panel inside of or interior to the exterior panel. A garment may have multiple interior panels. The interior panel may be adjacent to an exterior panel or may not be adjacent to the exterior panel, for instance, when there are multiple panels interior to the exterior panel.

Interior opening: As used herein, the phrase "interior opening" describes an opening in an interior panel or in the panels forming the interior assembly.

Middle panel: As used herein, the phrase "middle panel" describes a panel positioned between at least two other panels. The middle panel may be adjacent to an exterior panel, an interior panel, or one or more additional middle panels.

Water-Resistant Fabric: As used herein, "water-resistant fabric" is a fabric that is substantially impervious to water. In some exemplary aspects, the term "water-resistant fabric" may be defined as a fabric that has greater than 1,000 mm of water resistance, which is the amount of water, in mm, which can be suspended above the fabric before water seeps through. However, values above and below this threshold are contemplated as being within the scope herein.

Non-breathable Fabric: As used herein, "non-breathable fabric" is fabric that exhibits a low rate of moisture vapor transmission. In some exemplary aspects, a fabric may be defined as being non-breathable when it has a moisture vapor transmission rate less than 1000 ($g/m^2/d$), which is the rate at which water vapor passes through the fabric, in grams of water vapor per square meter of fabric per 24-hour period ($g/m^2/d$). However, values above and below this threshold are contemplated as being within the scope herein.

Weather-Resistant Fabric: As used herein, "Weather-Resistant Fabric" is a fabric that is generally resistant to water and/or wind. In some instances, a weather-resistant fabric may comprise a fabric that is substantially impervious to water and exhibits a low rate of moisture vapor transmission.

Passage: As used herein, the term "passage" is a space between garment layers where the garment layers are not directly connected. The passage is configured to and allows for the passage of moisture or moisture vapor and/or air.

FIG. 1 is a front view of a vented garment 100 in accordance with the technology described herein. The vented garment 100 in FIG. 1 may be made from conventional synthetic or natural fabrics. The fabrics may be water-repellent and/or fill proof, or alternatively, such as in the case of, for example, light-weight fabrics, they may be treated with waterproofing and/or down-proofing chemicals such as, for example, the chemical treatments referred to as DWR (durable water repellent). Since insulated garments may be down or synthetic thermal fiber filled, these treatments can help prevent the fill from poking through the fabric and help prevent water moisture from the environment from entering inside of the garment. However, as noted earlier, a downside of these chemical treatments on fabrics is that these treatments may decrease the ability for moisture vapor to evaporate from the garment.

Figure 3:
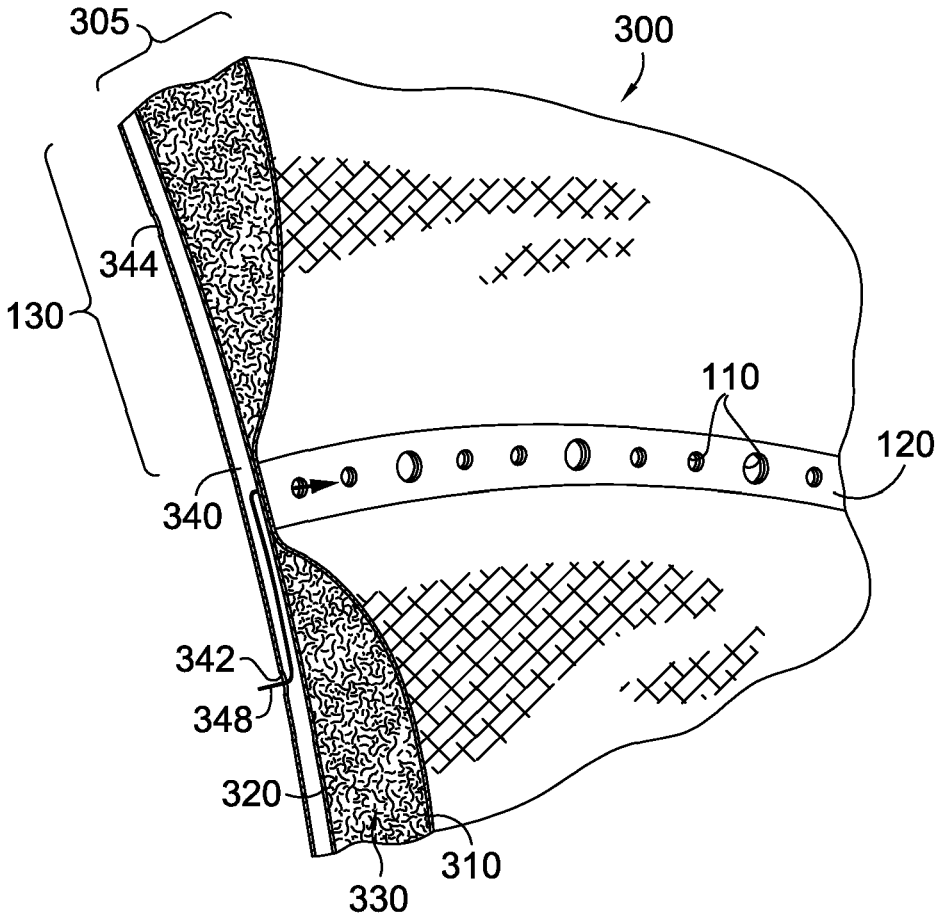
FIG. 3 is a close-up view of a section of a venting passage and insulating chambers from the vented garment in FIG. 1 in accordance with the technology described herein.

In an exemplary aspect, the vented garment 100 in FIG. 1 may be constructed by cutting out an interior panel and a corresponding exterior panel, for each section of the garment 100, from a fabric piece(s) (not shown). An adhesive tape suitable for the particular type of fabric may be placed on the interior face of one of the panels along predetermined sections of the panel to form chambers with a desired shape. Once the adhesive tape is set in place, the second panel may be aligned on top of the panel with the adhesive tape with its interior face facing the tape. Then, the two panels may be pressed together with sufficient force and/or energy applied to activate the adhesive tape to create a bond(s) between the two panels. The adhesive tape may be activated by, for instance, heat, or ultrasonic energy, or any other type of applied energy. Once the fabrics are bonded, seams, such as seam 120 are formed where the seams 120 define or delineate chambers, such as chamber 130, in between each seam 120. In exemplary aspects, the interior panel and the exterior panel adhered together at the seams 120 form an exterior garment panel as shown in FIG. 3.

The chambers 130 may then be filled with down, or synthetic-insulating fibers. Depending on the size and/or shape of the chambers 130 formed, the chambers 130 may be filled with down or thermal-insulating fibers either manually or mechanically.

In a different example of the vented garment, depending on the fabric material used, the seams may be created without the use of an adhesive tape. For example, the fabric may be formed from fibers that are reactive to different stimuli such as heat, sound waves, mechanical pressure, chemicals, water, and the like. Upon application of the stimulus to the fabric, the fibers may undergo a transformation that causes the fibers to adhere or bond to each other. In this aspect, the stimulus could be applied to only those portions of the fabric where seams are desired. Any and all aspects, and any variation thereof, are contemplated as being within the scope herein.

In exemplary aspects, the seams 120 may be spaced apart in a generally horizontal orientation on the garment 100 as shown in FIG. 1. Or the seams 120 may be spaced apart in a generally vertical orientation on the garment 100. The spacing of seams 120 may vary, as may the relative orientation of the seams 120 and/or the shape of the seams 120, enabling the chambers 130 to be different shapes and/or sizes. In some aspects, the seams 120 may be spaced such that there is minimal space between the seams 120, thereby resulting in a smaller-sized chamber 130 with less insulating fill. In other aspects, the seams 120 may be spaced more widely apart to create a larger-sized chamber 130 with greater amounts of insulating fill. In some exemplary aspects, spacing between the seams 120 may be greater than the width of the seam 120. In other exemplary aspects, spacing between the seams 120 may be greater than twice the width of the seam 120, and so on. Exemplary distances between adjacent seams 120 may comprise, for example, between 1 cm and 20 cm, between 2 cm and 15 cm, and/or between 3 cm and 10 cm, although ranges above and below these values are contemplated herein. In aspects, the spacing between adjacent seams 120 may be variable depending upon the desired amount of insulation needed at different portions of the garment 100.

The seams 120 may be perforated during bonding, after bonding, and/or after filling the chambers 130. In exemplary aspects, openings 110 in the seams 120 may be formed using, for instance, a laser, an ultrasonic cutter, a water-jet cutter, a mechanical cutter, and the like. Provided the proper equipment, the seams 120 may be simultaneously formed and perforated in a single step to form the openings 110, although the seams 120 and the openings 110 may be formed in separate steps without departing from the scope of the technology described herein. In other aspects, the openings 110 may be integrally formed in the seams 120 during a knitting or weaving process. As well, the seams 120 themselves may be formed during the knitting or weaving process. For example, a Jacquard head may be used to integrally knit the seams 120 and the chambers 130. Moreover, this same knitting or weaving process may be used to integrally fill the chambers 130 using float yarns at the time they are created. Any and all aspects, and any variation thereof, are contemplated as being within the scope herein.

The plurality of openings 110 may provide ventilation and moisture management by allowing moisture vapor from perspiration and/or heat to escape to the exterior environment. The location of the openings 110 in the interior and exterior panels can vary in different aspects. For example, the openings 110 may penetrate both panels in the seam 120 (e.g., penetrate the exterior garment panel in the seam 120) and additional offset openings may be provided in an additional interior panel as shown in FIG. 3 and as discussed below. In another example, in a two-panel garment (e.g., in a garment comprising just the exterior garment panel without the additional interior panel), the holes or openings 110 in the exterior panel in the seam 120 can be offset from openings in the interior panel at the seam 120 as shown and discussed below with respect to, for example, FIGS. 6 and 7.

Figure 2:
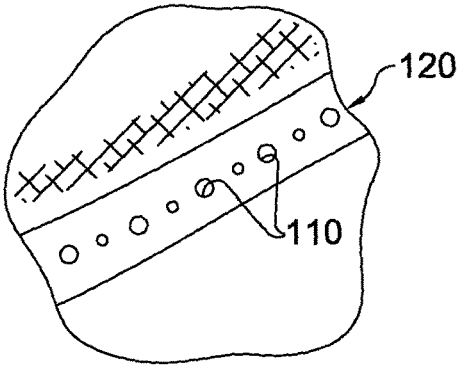
FIG. 2 is a close-up view of a venting seam from the vented garment in FIG. 1.

FIG. 2 is a close-up view of one of the seams 120. The seam 120 may be formed as described above (e.g., adhering an exterior panel to an interior panel at the seam 120 to form an exterior garment panel), may be presented in a straight line (as shown), in a curved line, in a wavy line, or any other shape that may be useful, for example in forming and defining the chamber 130 and being visually appealing at the same time. The plurality of openings 110 may be of the same size, or different sizes (as shown). The plurality of openings 110 may be of different shapes such as circular (as shown), triangular, rectangular, or any other shape desired. The plurality of openings 110 may be evenly spaced in a straight line, curvy line, zig-zag, or any other suitable shape for placing the plurality of openings 110 on the seam 120. Additionally, depending on the size of the individual openings, there may be multiple rows of openings 110 on each seam 120. The plurality of openings 110 may be presented continuously along the seam 120 (as shown), or may be presented intermittently along the seam 120, or may be strategically placed only in the areas of high perspiration such as along the back of a wearer, under the arms of a wearer, between the legs of a wearer, and the like.

The garment construction may become more apparent in reference to FIG. 3, where an angled cross-sectional view 300 of a small section of the garment 100 is shown. The garment 100 in accordance with the technology described herein may be constructed from an exterior panel 310 and a middle panel 320 that together form an exterior garment panel 305, and an interior panel 344. In exemplary aspects, one or more of the panels 310, 320, and/or 344 may be formed from a fabric that is substantially impervious to water and/or a fabric that exhibits a low rate of moisture vapor transmission. Moreover, in exemplary aspects, the interior panel 344 may comprise a mesh material, or a material having moisture-wicking or moisture-management properties. Including a mesh material or a material having moisture-wicking or moisture-management properties as the interior panel 344 may increase wearer comfort.

The seam 120 and the chamber 130 may be created as described above in reference to FIG. 1 (e.g., adhering the exterior panel 310 to the middle panel 320 at the seams 120 to form the exterior garment panel 305). The edges of the chambers 130 are formed by the seam 120. In other words, the seam 120 delineates and defines the chamber 130. The chamber 130 may then be filled with a fill 330, such as down or synthetic fibers. In aspects, once filled, the vapor transmission rate of the garment 100 may be reduced even when the fabric used to form the garment 100 comprises a breathable material because the chambers 130 may hinder the transmission of moisture vapor through the garment 100. The openings 110 extending through the seam 120 may comprise exterior openings in that they open to the external environment.

In exemplary aspects, the interior panel 344 may be somewhat loosely affixed to the exterior garment panel 305 at one or more locations such that the interior panel 344 may be spaced apart from the exterior garment panel 305 at areas where it is not affixed. In other words, a void or space 340 may be formed between the interior panel 344 and the inner-facing surface of the middle panel 320, where the space 340 may function as a passage for transmission of moisture vapor and/or air. The interior panel 344 comprises a plurality of interior openings, such as interior opening 342. The openings 342 may be thought of as interior openings in that they do not directly communicate with the external environment in contrast to the exterior openings 110. The interior openings 342 on the interior panel 344 are configured such that the interior openings 342 are offset from the exterior openings 110. In other words, there is not a direct communication path between the exterior openings 110 and the interior openings 342. This is indicated in FIG. 3 by the arrow 348, which indicates the route that moisture vapor and/or air would traverse when traveling, namely: 1) from the wearer's body, 2) through the interior opening 342, 3) into the space 340, and 4) out the exterior opening 110 where the moisture vapor may be discharged into the external environment.

The interior openings 342 in the interior panel 344 may be distributed throughout the interior panel 344 and/or may be localized in certain areas depending on the level of ventilation and/or breathability needed in a certain area. In one exemplary aspect, the interior openings 342 on the interior panel 344 are configured to not overlap with the exterior openings 110 associated with the exterior garment panel 305. In another exemplary aspect, the distribution of the interior openings 342 in the interior panel 344 may be configured such that a majority of the interior openings 342 (e.g., greater than 50%, 70%, 80%, or 90%) do not overlap with the exterior openings 110.

The size and number of the openings 342 and 110 may be adjusted to provide different ventilation and breathability characteristics, while still maintaining the structural integrity of the fabric and a high level of thermal insulation. For instance, a larger size and greater number of openings 342 and 110 in portions of the garment 100 may provide a higher degree of ventilation and breathability characteristics to these portions. In another example, a smaller size and a fewer number of openings 342 and 110 in other portions of the garment 100 may provide for a lower degree of ventilation and breathability characteristics. Thus, by adjusting the size and/or number of the openings 342 and 110, different ventilation and breathability characteristics may be imparted to different portions of the garment 100. In exemplary aspects, the width size of each individual opening 342 and 110 may range anywhere from 0.1 mm to 5 mm, and the spacing between each individual opening 342 and 110 measured from edge to edge, may range anywhere from 0.5 mm to 10 mm. Other sizes and/or spacing of openings 342 and 110 may be used without departing from the scope of the technology described herein.

Figure 4:
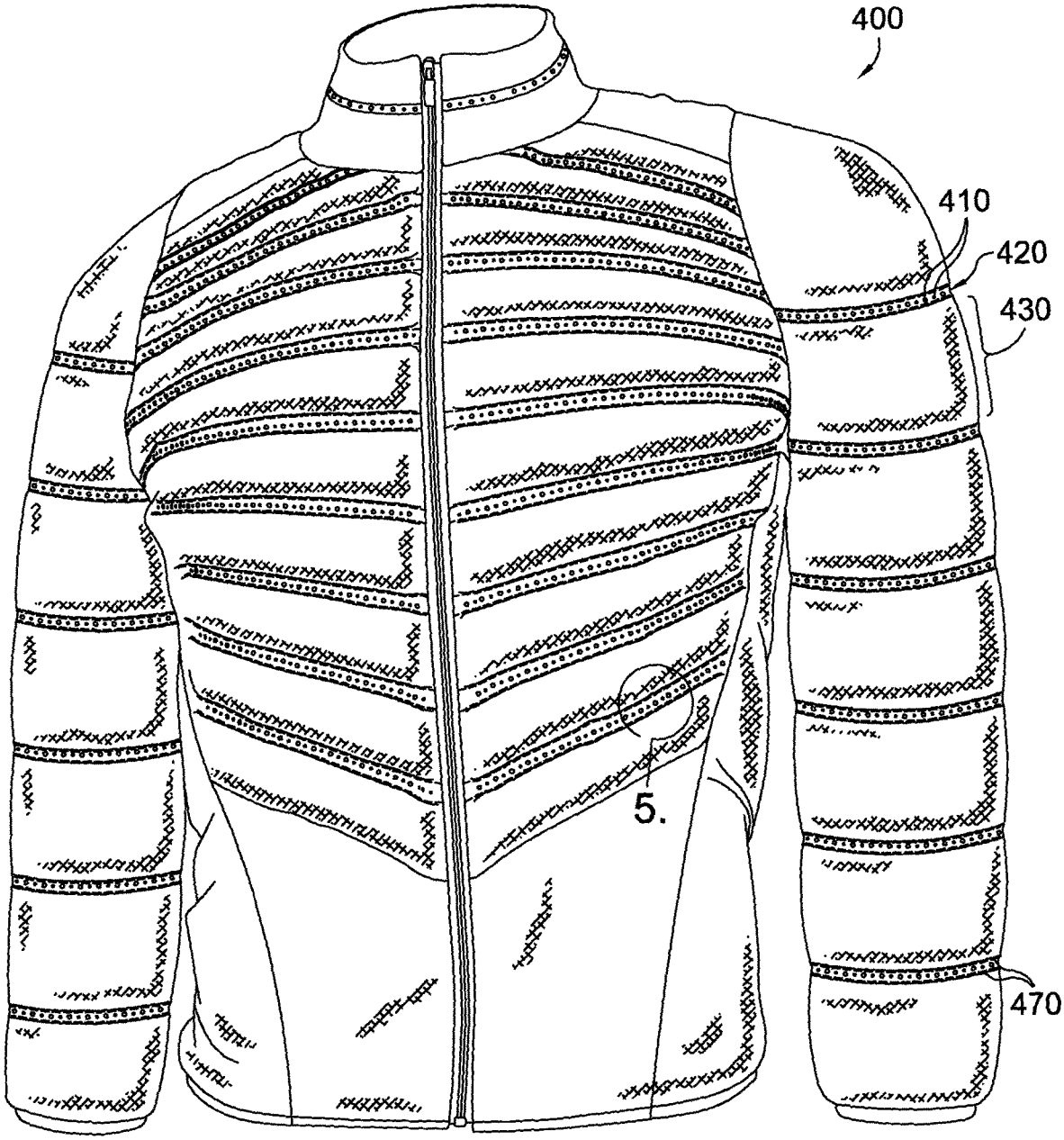
FIG. 4 is a view of a different exemplary vented garment in accordance with the technology described herein.
Figure 5:
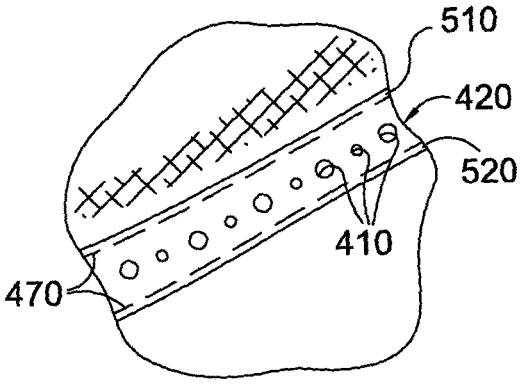
FIG. 5 is a close up view of a venting seam with stiches from the vented garment in FIG. 4 in accordance with the technology described herein.

Now, in reference generally to FIGS. 4-7, and particularly to FIG. 4, a front view of another different vented garment 400 is shown in accordance with an aspect of the technology described herein. With respect to the garment 400, the garment 400 may comprise an exterior panel adhered to an interior panel at seams 420 to form an exterior garment panel, where the seams 420 define chambers 430 that may be filled with a fill material. But the garment 400 may not have an additional interior panel as described for the garment 100. The vented garment 400 in FIG. 4 may be constructed in a fashion similar to that described above with regard to the garment 100 shown in FIG. 1 to form the seams 420. Moreover, the seams 420 may be further reinforced by adding stitching 470 along their upper seam boundary 510 and/or lower seam boundary 520, as can be seen in the close up view of FIG. 5. Although stitching is shown in FIG. 5, other methods of selectively affixing the seam 420 are contemplated herein such as use of adhesives, bonding, spot welding, and the like. Stitching 470 may be applied mechanically and/or by hand, and may use any type of thread, whether natural or synthetic. Likewise, stitching 470 may be applied before or after openings 410 are formed and/or before or after the chambers 430 are filled. In one aspect, the part of the seam 420 between the upper seam boundary 510 and the lower seam boundary 520 is configured to remain open to form a passage for moisture vapor and/or air to pass between the exterior and interior panels.

The vented garment 400 may be vented using offset openings within the seams 420. In other words, the exterior openings 410 in the garment's exterior panel may be offset from openings in the garment's interior panel (better shown in FIGS. 6 and 7) at the seams 420. The offset openings force moisture to pass through a passage within the seam 420 formed between the interior and exterior panels. The arrangement of the exterior and interior openings is illustrated with more detail in FIGS. 6 and 7.

Figure 6:
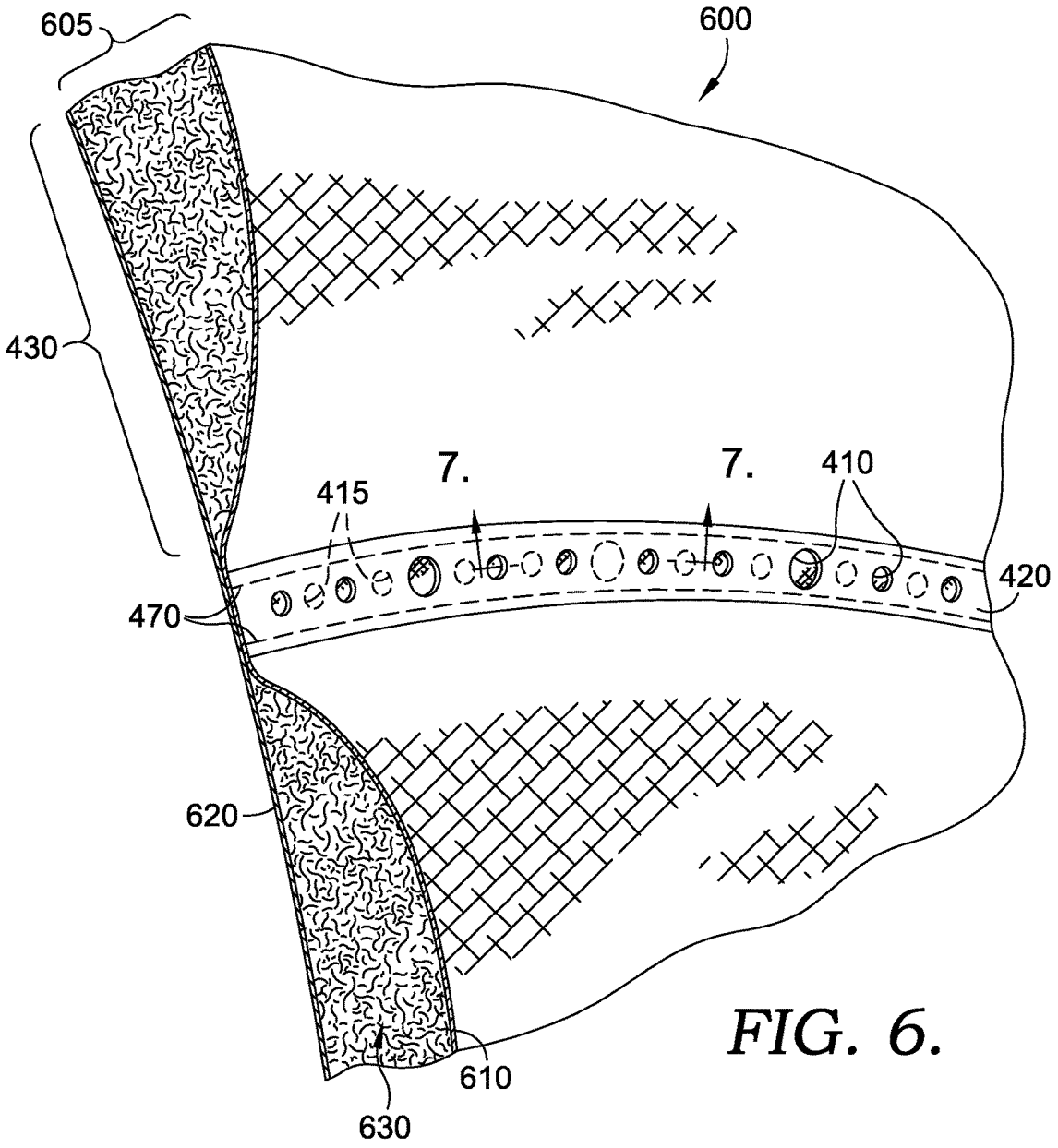
FIG. 6 is a close-up view of a section of the venting seam from the garment of FIG. 4 in accordance with the technology described herein.

FIG. 6 shows an angled cross-sectional view 600 of a small section of the garment 400. The garment 400, in accordance with the technology described herein, may be constructed from an interior panel 620 and an exterior panel 610, where the interior panel 620 is affixed to the exterior panel 610 at the seam 420 to form an exterior garment panel 605. The seam 420 delineates and defines in part the chambers 430. The chambers 430 may then be filled with fill 630, such as down or synthetic fibers.

In the example shown in FIG. 6, the seam 420 comprises both exterior openings 410 and interior openings 415 (shown as dashed circles) that are offset from the exterior openings 410. The exterior openings 410, in some exemplary aspects, are formed just through the exterior panel 610 and may be open to or in communication with the external environment, while the interior openings 415 are formed just through the interior panel 620 and are not in direct communication with the external environment. As used herein, the term "offset" means the interior area of an exterior opening 410 does not overlap with the interior area of the interior opening 415. The offsetting of the exterior openings 410 from the interior openings 415 forces moisture and/or heat exiting the garment 400 to traverse a passage within the seam 420 connecting the interior openings 415 and exterior openings 410 as shown in FIG. 7.

Figure 7:
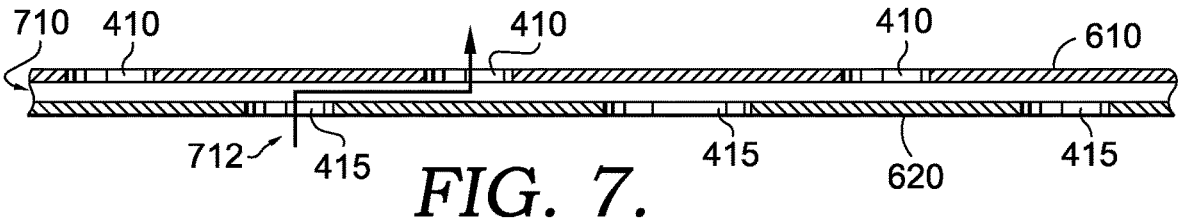
FIG. 7 is a cross-sectional view of a small section of the seam area in FIG. 6, where the insulating chambers are shown in relation to the openings in the seams in accordance with the technology described herein.

FIG. 7 provides a cross-section of the seam 420 to illustrate the offset nature of the exterior openings 410 and the interior openings 415 according to an aspect. As previously described and as shown in FIG. 5, the seam 420 is formed by affixing in part the exterior panel 610 and the interior panel 620 at the upper seam boundary 510 and the lower seam boundary 520. By just affixing the panels 610 and 620 at the upper seam boundary 510 and the lower seam boundary 520, a passage or space 710 is maintained between the exterior panel 610 and the interior panel 620 as shown in FIG. 7. Thus, as shown by the arrow 712, moisture vapor and/or air would leave the wearer's body by traveling through the interior opening 415, traversing the passage or space 710, and exiting via the exterior opening 410 where it can be dissipated into the external environment. The exterior openings 410 and the interior openings 415 are shown as evenly spaced and/or sized in FIGS. 6 and 7, but other arrangements are possible as described herein.

Like the vented garment 100 of FIG. 1, the vented garment 400 in FIG. 4 may be made from conventional synthetic or natural fabrics. The fabrics may be water repellent and down proof, or alternatively, such as in the case of ultra-light fabrics (29 $g/m^2$ or lower) and light-weight fabrics (89 $g/m^2$-30 $g/m^2$), the fabrics may need to be treated with waterproofing and down-proofing chemicals, such as, for example, the chemical treatments referred to as DWR (durable water repellent).

In some exemplary aspects, the insulating chambers in the vented garment in accordance with the technology described herein may be formed by welding separate pieces of fabric at each seam, or as discussed earlier, may be formed by pressing two whole panels with adhesive tape in strategic places in between the two panels. In the example where the chambers may be formed by welding separate pieces of fabric at each seam, this would allow for the introduction of different textures, colors, or functionalities by introducing different types of fabrics at different sections of the garment. Further, as described earlier, in one aspect, one or more portions of the insulating zones and/or the vented garments are constructed using an engineered weaving or knitting process (e.g., program a weaving or knitting machine to form these structures).

Figure 8:
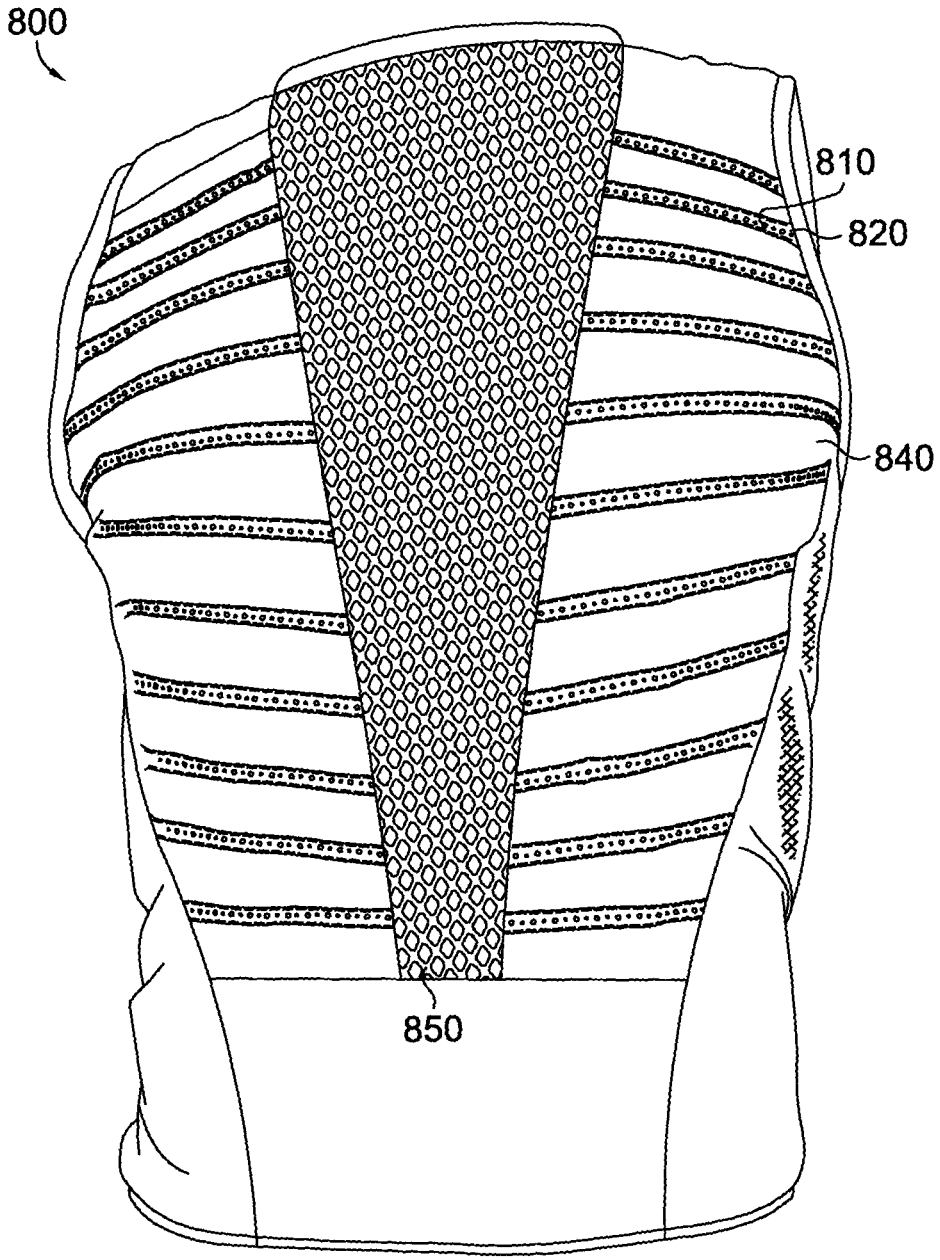
FIG. 8 is an additional exemplary vented garment that comprises a mesh back section in accordance with the technology described herein.

Further, the vented insulating garment examples shown in the examples of FIG. 1 and FIG. 4 are vented cold-weather jackets or coats. However, the insulating vented garments, in accordance with the technology described herein, may also be constructed in the form of vests, pants, overalls, gloves, hats, and the like. FIG. 8 is an example of a vest 800 in accordance with the technology described herein. As seen in FIG. 8, the vest 800 may have seams 820 with a plurality of openings 810, forming thermally insulating chambers 840, which may be filled with down, or any other thermally-insulating material, such as polyester fibers. In exemplary aspects, the insulating portions of the vest 800 may be formed as shown in FIG. 3 and/or the insulating portions of the vest 800 may be formed as shown in FIGS. 5-7. Any and all aspects, and any variation thereof, are contemplated as being within the scope herein. The vest 800 may be used as a light-weight, breathable, thermal-insulation garment, for example by a runner. The vest 800 may comprise a mesh vent area 850 to provide additional ventilation.

Figure 9:
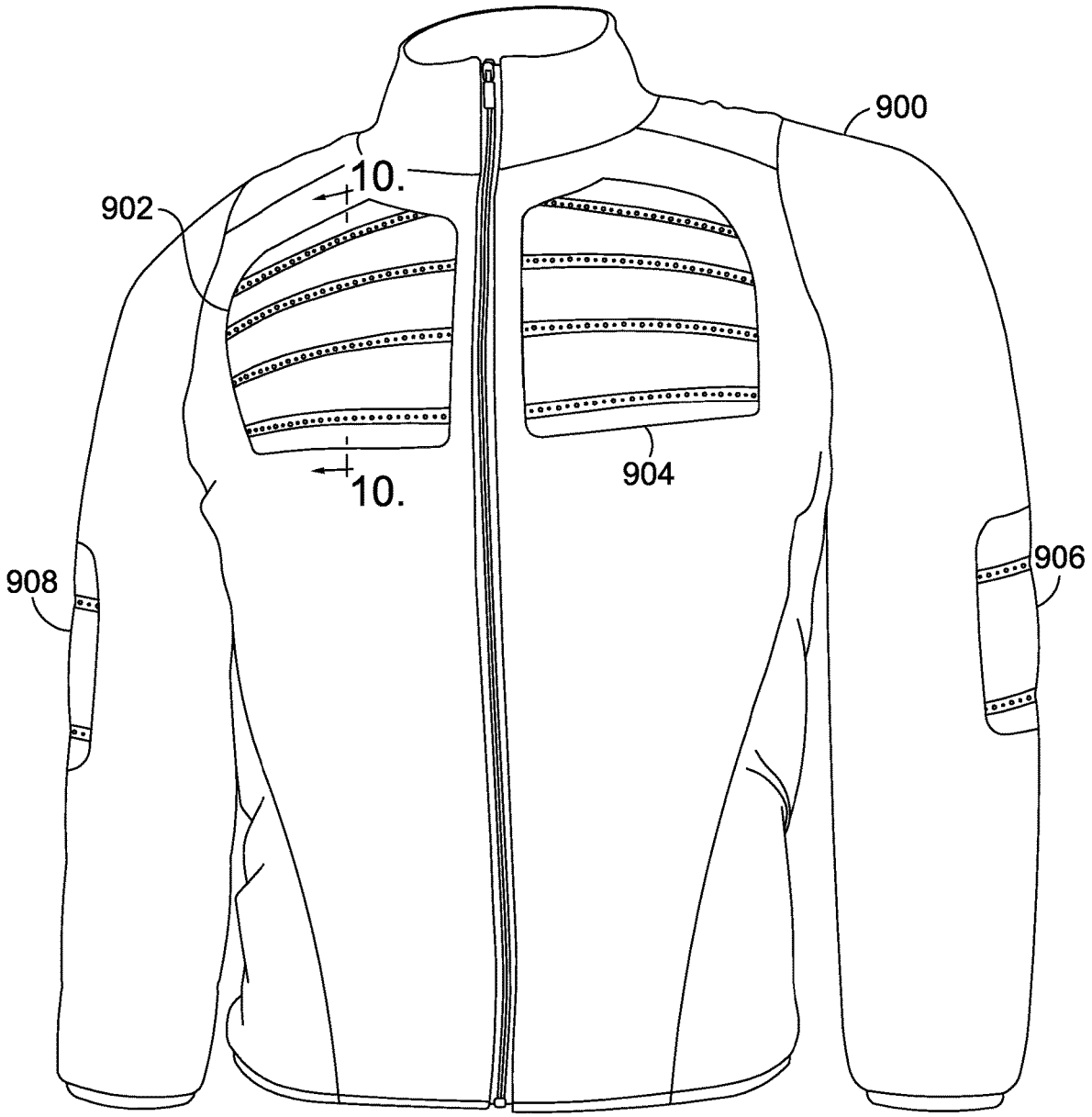
FIG. 9 is a view of an additional exemplary vented garment with localized vented-insulation sections in accordance with the technology described herein.

In various embodiments, the vented insulation zones, as described herein, may be located in parts of the garment instead of throughout the garment. FIG. 9 shows a garment 900 with a right-chest vented insulation zone 902, a left-chest vented insulation zone 904, a left-arm vented insulation zone 906, and a right-arm vented insulation zone 908. The vented insulation zones 902, 904, 906, and 908 may be located to maximize the retention of heat while still allowing for moisture venting. For example, the vented insulation zones 902, 904, 906, and 908 may be located in areas of the body that produce more perspiration or areas that produce more heat or need an increased amount of vapor escape, such as the chest region, thighs, and the like. Another example is that the insulation zones 902, 904, 906, and 908 may be located in regions of the body that are more sensitive to cold. The insulation zones 902, 904, 906, and 908 may also be located based on the comfort of the wearer when exercising.

Figure 10:
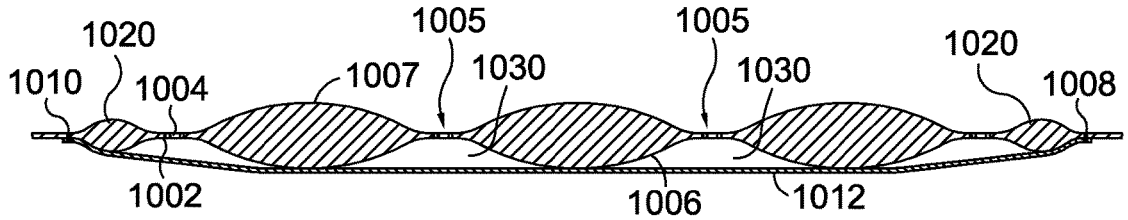
FIG. 10 is a cross-sectional view of the a localized vented-insulation section in FIG. 9 in accordance with the technology described herein.

Turning now to FIG. 10, a cross-section of the right chest vented insulation zone 902 is provided. The right-chest vented insulation zone 902 can be installed within the garment 900 by, for instance, cutting out a portion of the garment 900 and adding the insulation zone 902 in place of the cutout area. The insulation zone 902 is joined to the garment 900 at seam 1008 and seam 1010. The right-chest vented insulation zone 902 comprises chambers 1020 formed by joining an interior panel 1006 and an exterior panel 1007 at one or more seams 1005 to form an exterior garment panel. In one exemplary aspect, the seams 1005 comprise offset exterior openings 1004 and interior openings 1002. This configuration is similar to that shown in, for example, FIGS. 6 and 7. Alternatively, the seams 1005 may comprise exterior openings 1004 and the interior openings may be formed in a panel 1012 that is attached to the interior-facing side (next to the wearer) of the interior panel 1006 of the garment, where a passage or space 1030 is formed between the panel 1012 and the interior panel 1006. This configuration would be similar to that shown in FIG. 3. Any and all aspects, and any variation thereof, are contemplated as being within the scope herein.

Figure 11:
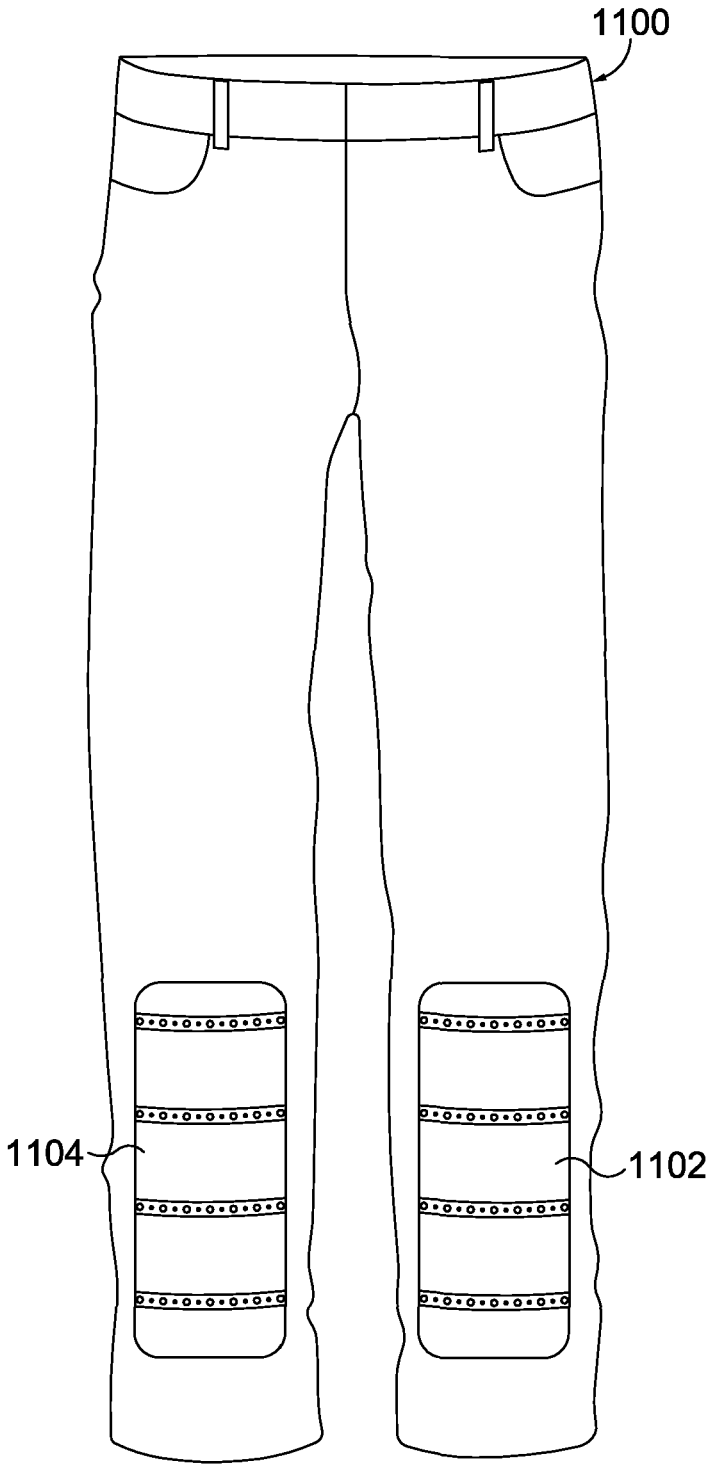
FIG. 11 is a view of vented pants with localized vented-insulation sections in accordance with the technology described herein.

Turning now to FIGS. 11-20, a number of exemplary configurations of insulation zones are depicted in accordance with aspects herein. The insulation zones shown in these figures have an exemplary exterior/interior opening configuration similar to that shown in, for example, FIG. 3 and/or FIGS. 5-7. For example, FIG. 11 depicts insulation zones within pants 1100. The right insulation zone 1104 and the left insulation zone 1102 are located in the shin areas, although aspects are not limited to these locations. Insulation zones may be installed in other pant locations.

Figure 12:
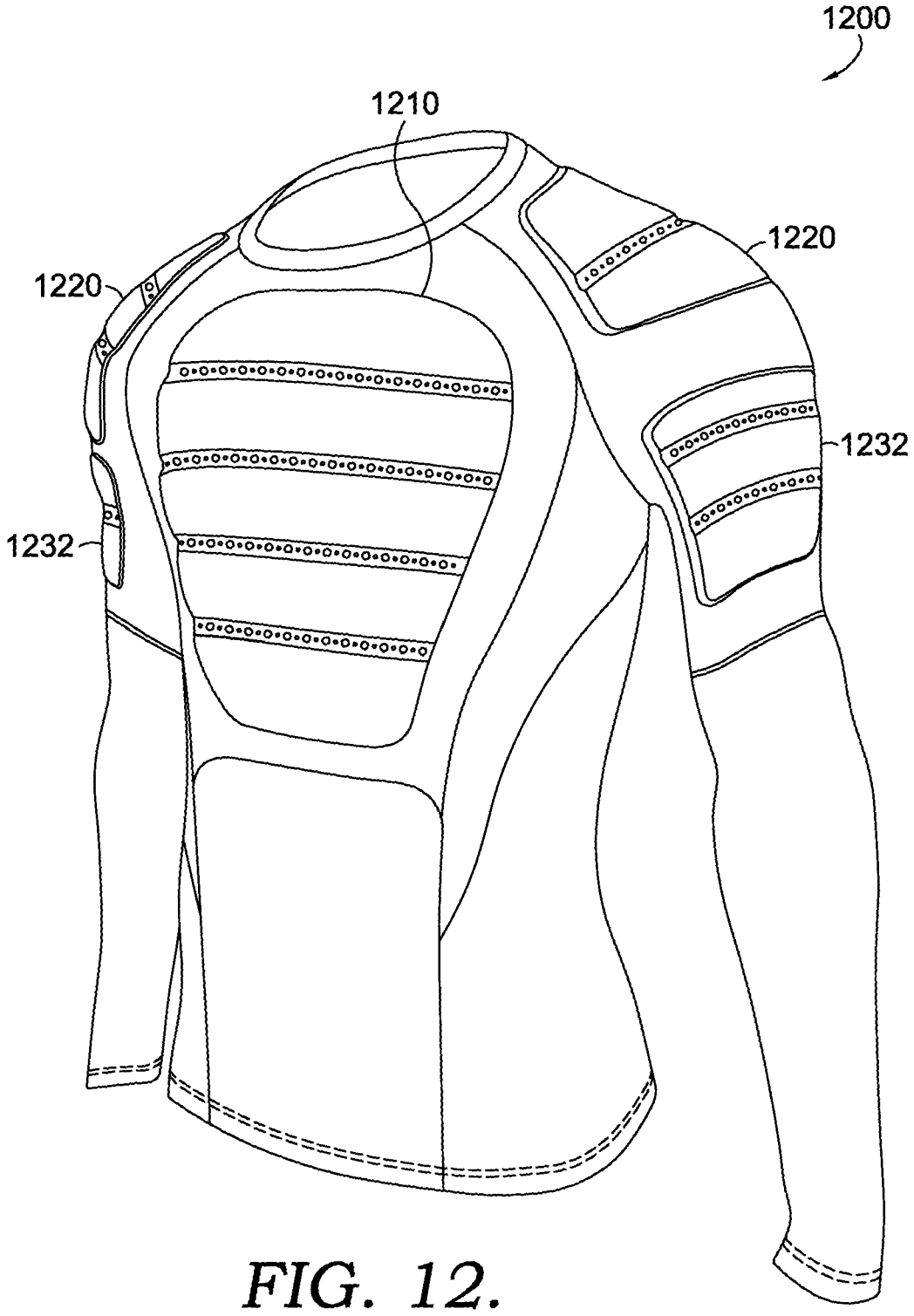
FIG. 12 is a front view of a vented top with localized vented-insulation sections in accordance with the technology described herein.
Figure 13:
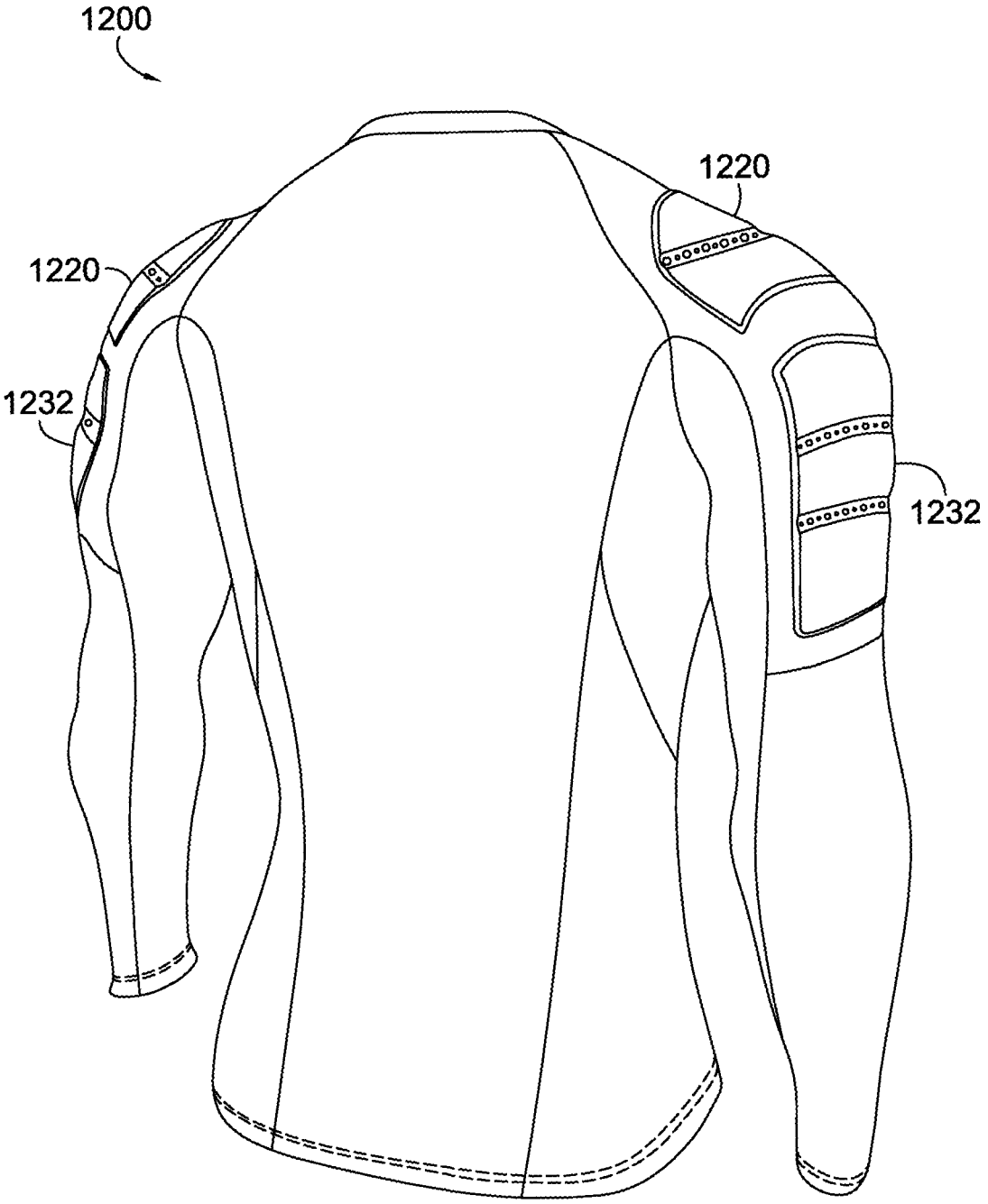
FIG. 13 is a back view of a vented top with localized vented-insulation sections in accordance with the technology described herein.

FIG. 12 depicts insulation zones within an athletic top 1200 in accordance with an aspect of the technology described herein. As shown in the perspective view of FIG. 12, the athletic top 1200 comprises a chest insulation zone 1210, right and left-shoulder insulation zones 1220, and upper right and left-arm insulation zones 1232. FIG. 13 depicts another perspective view of the athletic top 1200 and illustrates more clearly the right-shoulder insulation zone 1220 and the upper right-arm insulation zone 1232 in accordance with an aspect of the technology described herein.

Figure 14:
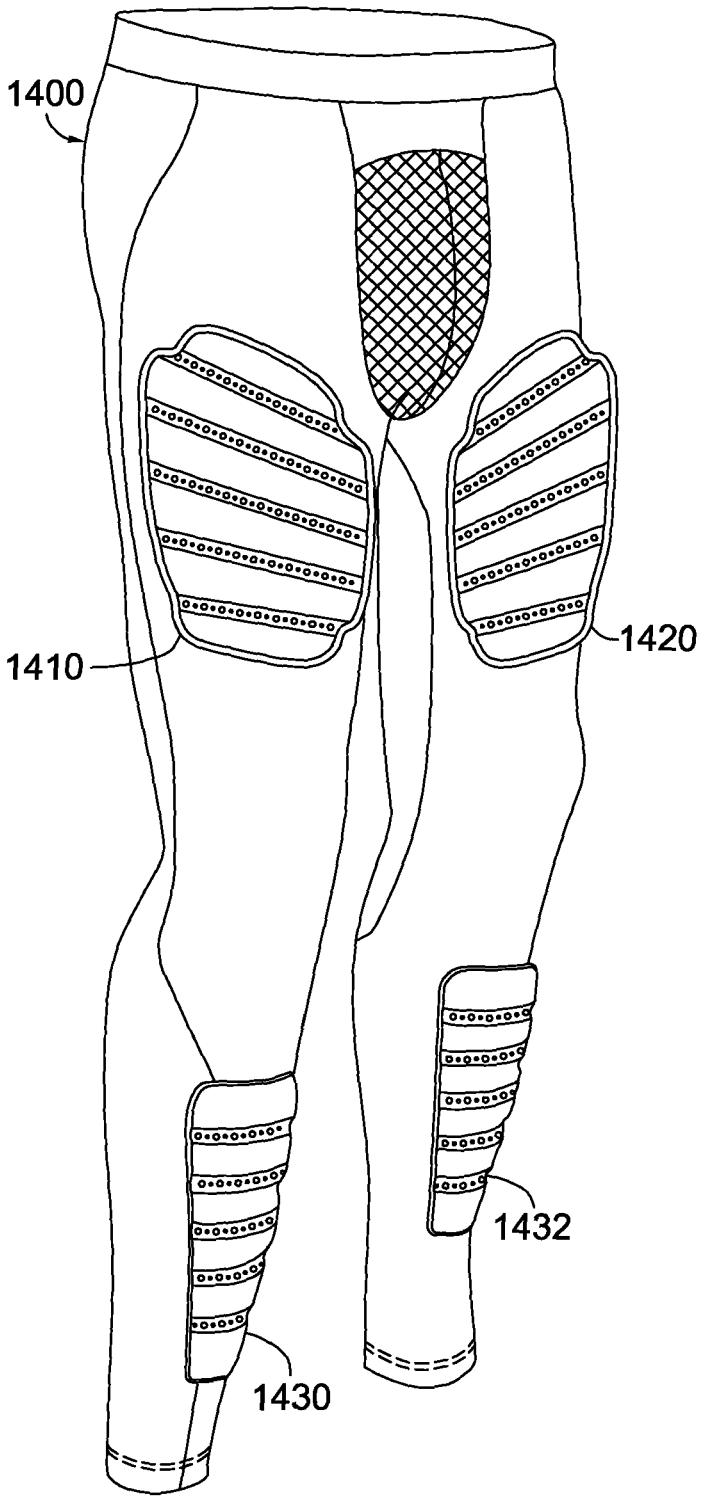
FIG. 14 is a perspective view of vented pants with localized vented-insulation sections in accordance with the technology described herein.
Figure 15:
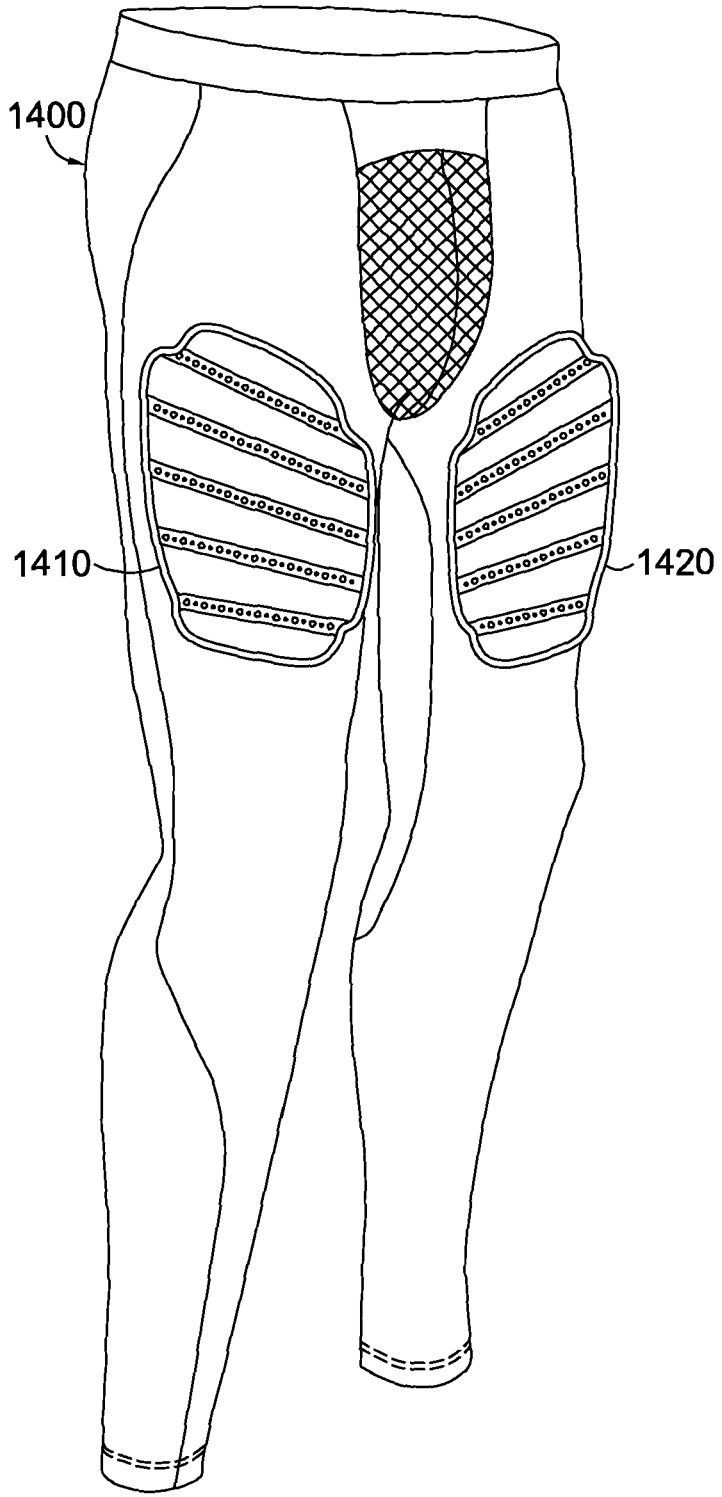
FIG. 15 is a perspective view of vented pants with localized vented-insulation sections in accordance with the technology described herein.

Turning now to FIG. 14, insulation zones within compression pants 1400 are shown, in accordance with an aspect of the technology described herein. The pants 1400 comprise a right-thigh insulation zone 1410 and a left-thigh insulation zone 1420. The pants 1400 also comprise a right-shin insulation zone 1430, and a left-shin insulation zone 1432. In exemplary aspect, the compression pant 1400 may comprise just the right-thigh insulation zone 1410 and the left-thigh insulation zone 1420. This aspect is shown in FIG. 15, which depicts compression pants 1500 having a right-thigh insulation zone 1510 and a left-thigh insulation zone 1520.

Figure 16:
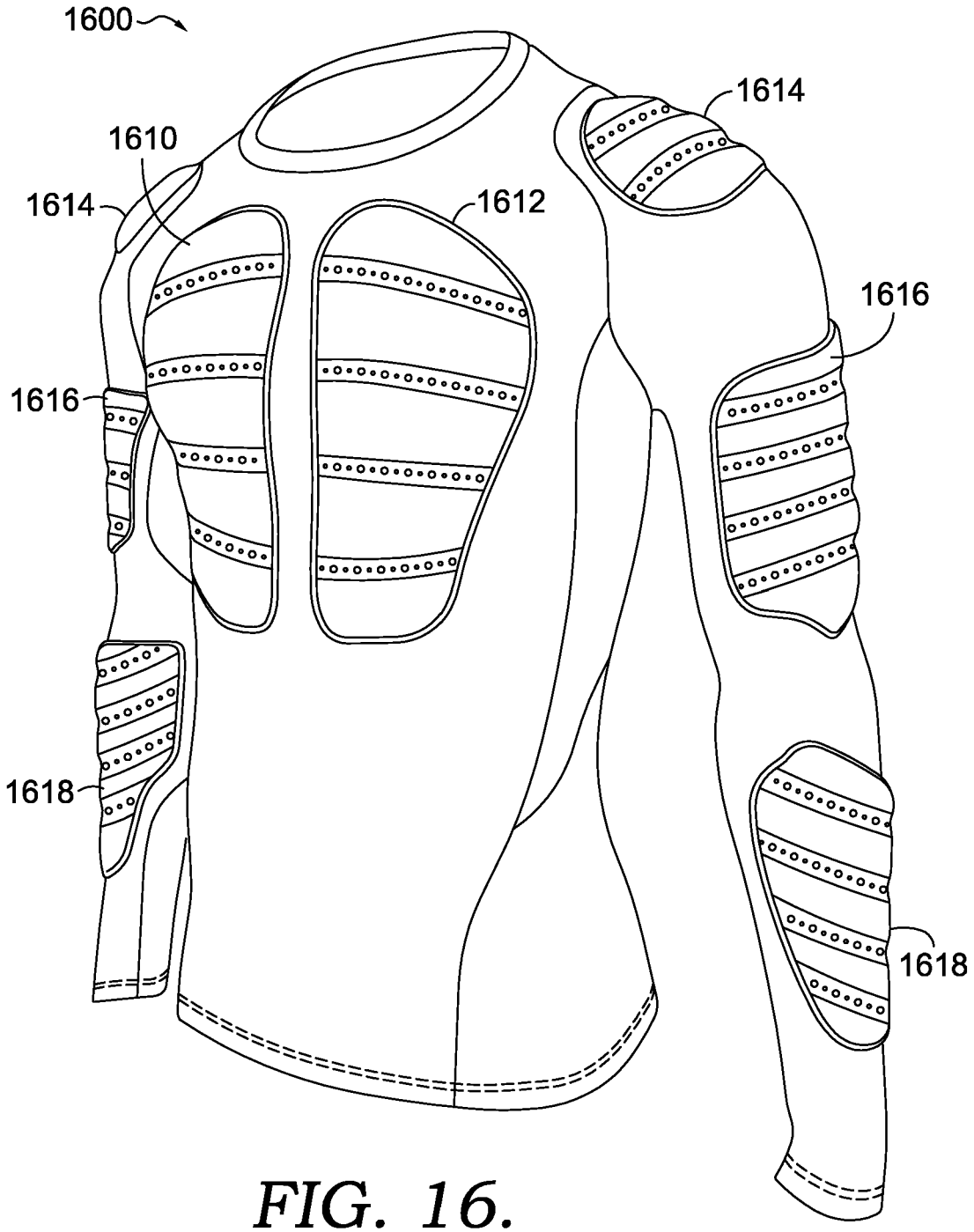
FIG. 16 is a front view of a vented top with localized vented-insulation sections in accordance with the technology described herein.
Figure 17:
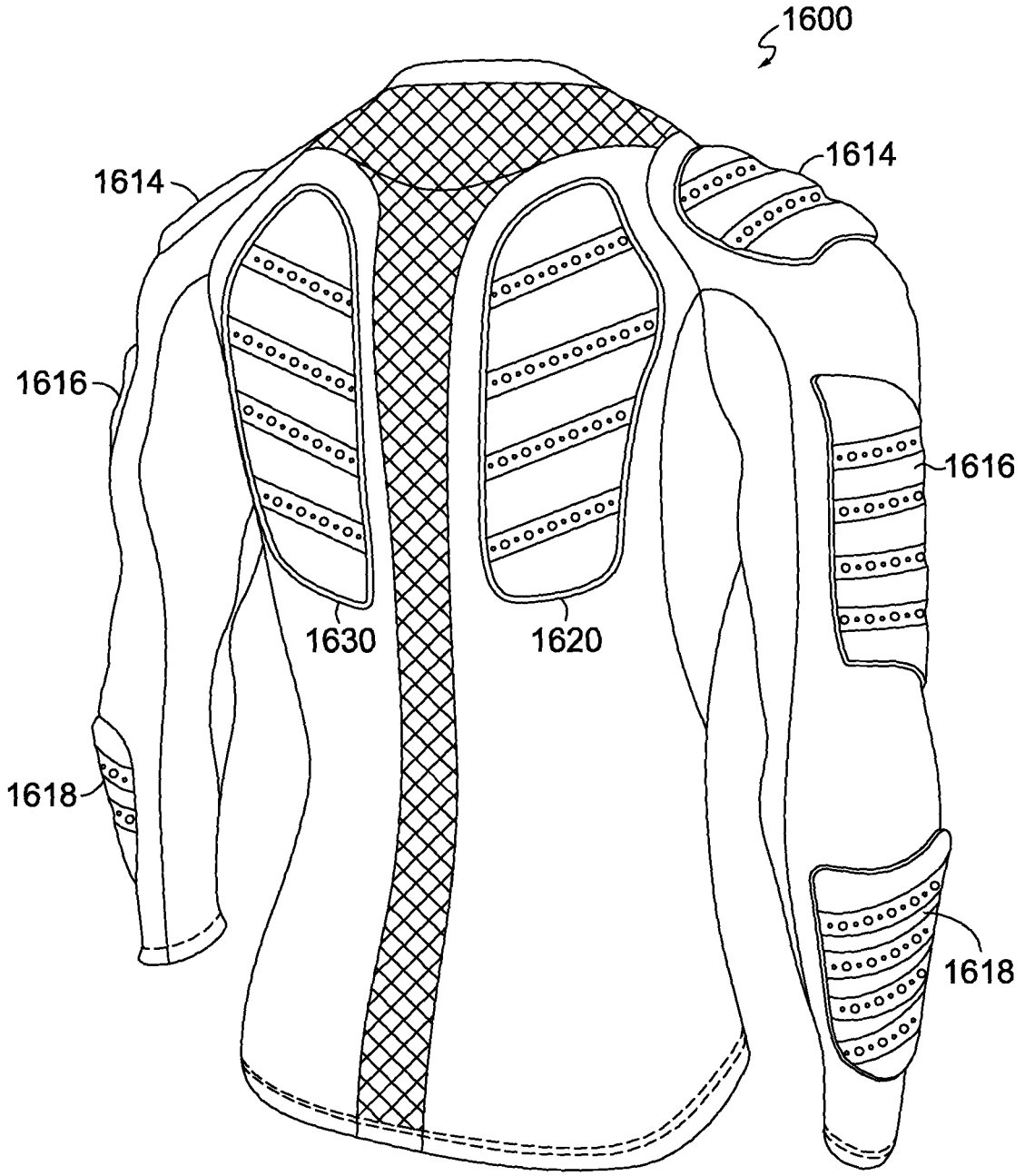
FIG. 17 is a back view of a vented top with localized vented-insulation sections in accordance with the technology described herein.

Turning now to FIG. 16, insulation zones within an athletic top 1600 are shown, in accordance with an aspect of the technology described herein. The athletic top 1600 comprises a right-chest insulation zone 1610 and a left-chest insulation zone 1612. The athletic top 1600 also comprises a left and right-shoulder insulation zones 1614, upper left and right-arm insulation zones 1616, and left and right-forearm insulation zones 1618. Turning now to FIG. 17, a rear-view of the athletic top 1600 illustrates a right-back insulation zone 1620 and a left-back insulation zone 1630, in accordance with an aspect of the technology described herein.

Figure 18:
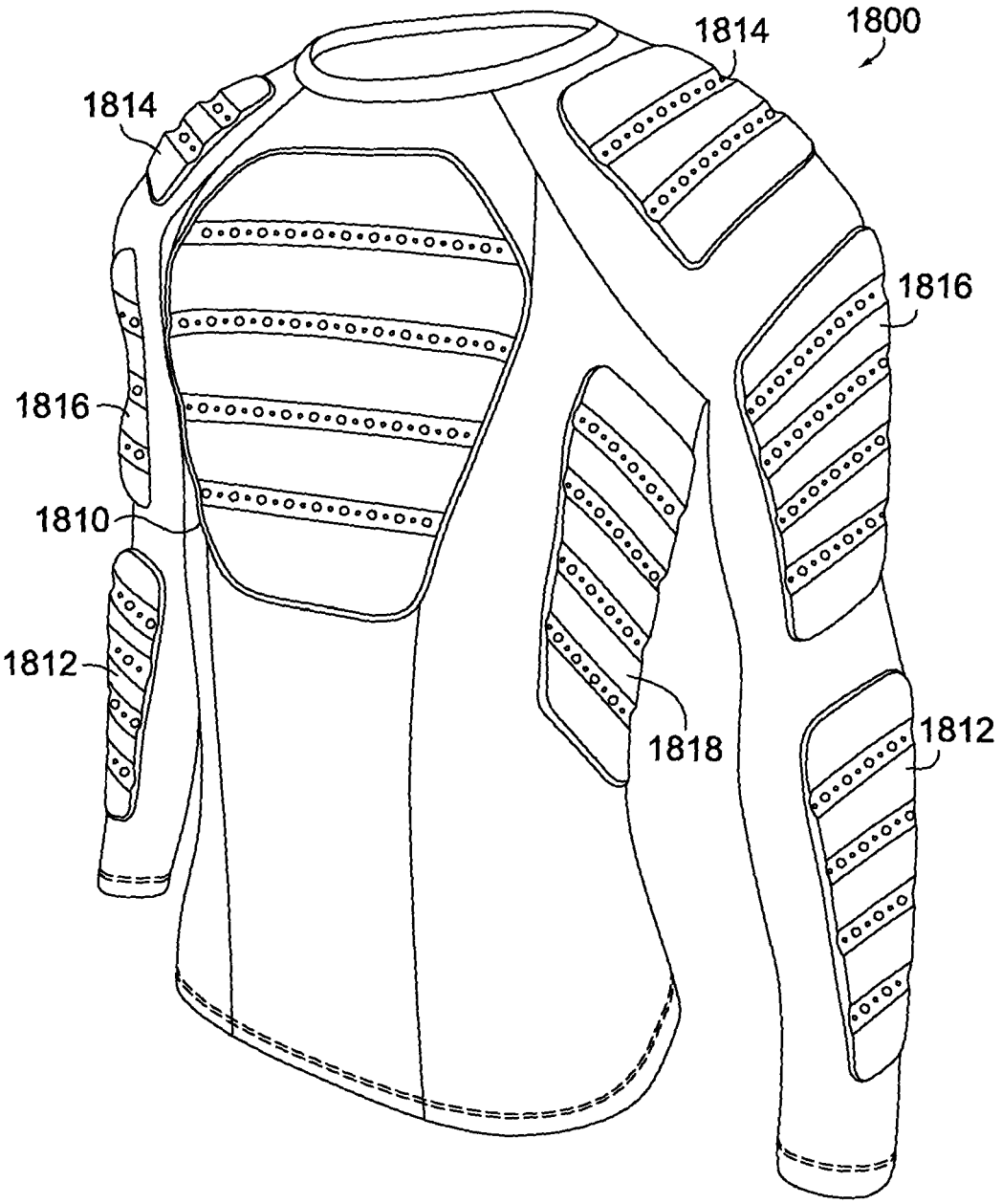
FIG. 18 is a front view of a vented top with localized vented-insulation sections in accordance with the technology described herein.
Figure 19:
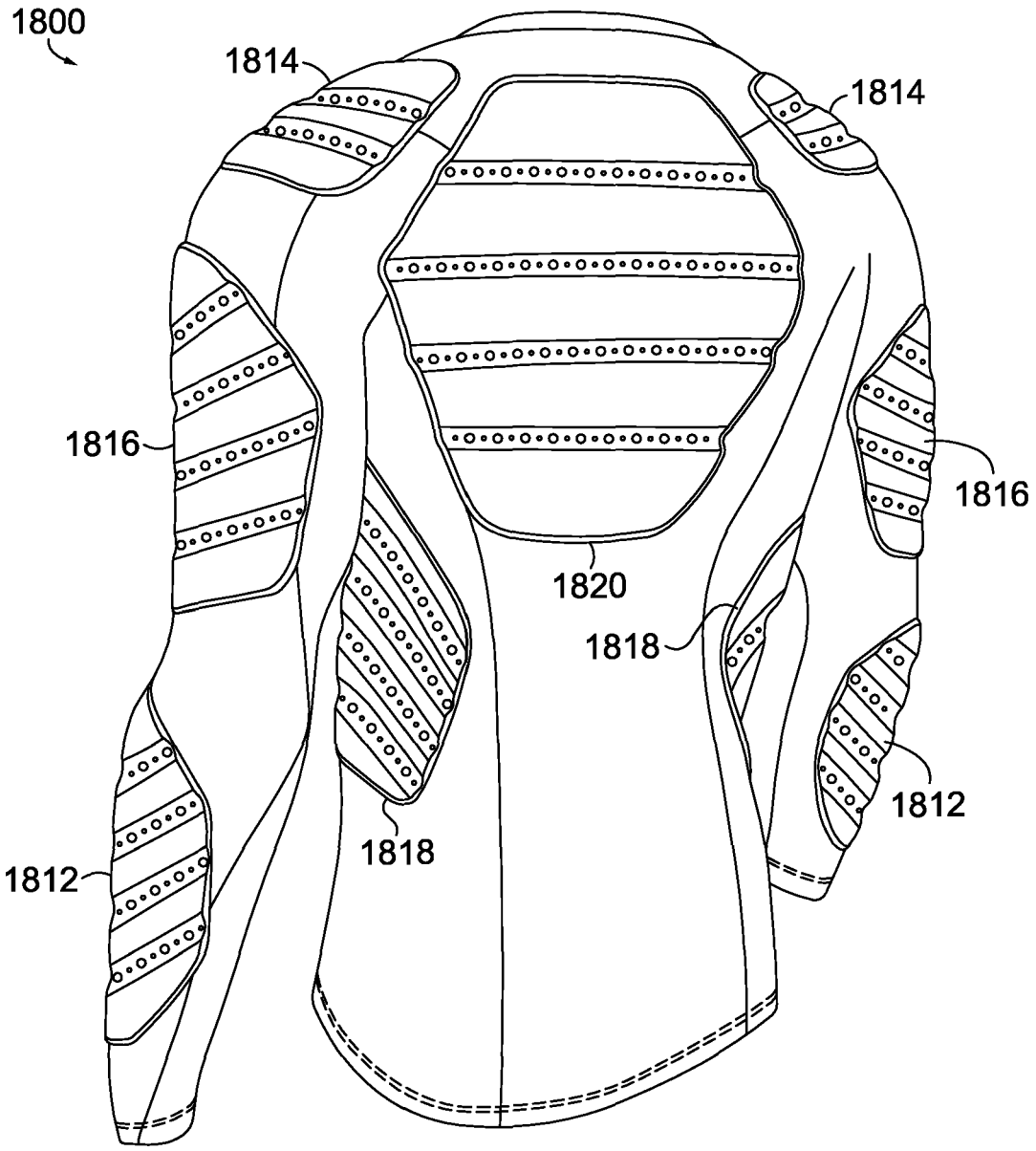
FIG. 19 is a back view of a vented top with localized vented-insulation sections in accordance with the technology described herein.

Turning now to FIG. 18, insulation zones within an athletic top 1800 are shown, in accordance with an aspect of the technology described herein. The athletic top 1800 comprises a chest insulation zone 1810, right and left-shoulder insulation zones 1814, upper right and left-arm insulation zones 1816, right and left-arm forearm insulation zones 1812, and right and left-side insulation zones 1818 (only the left-side insulation zone 1818 is shown in FIG. 18). Turning now to FIG. 19, a rear-view of the athletic top 1800 further shows a back insulation zone 1820 and the right-side insulation zone 1818 in accordance with an aspect of the technology described herein.

Figure 20:
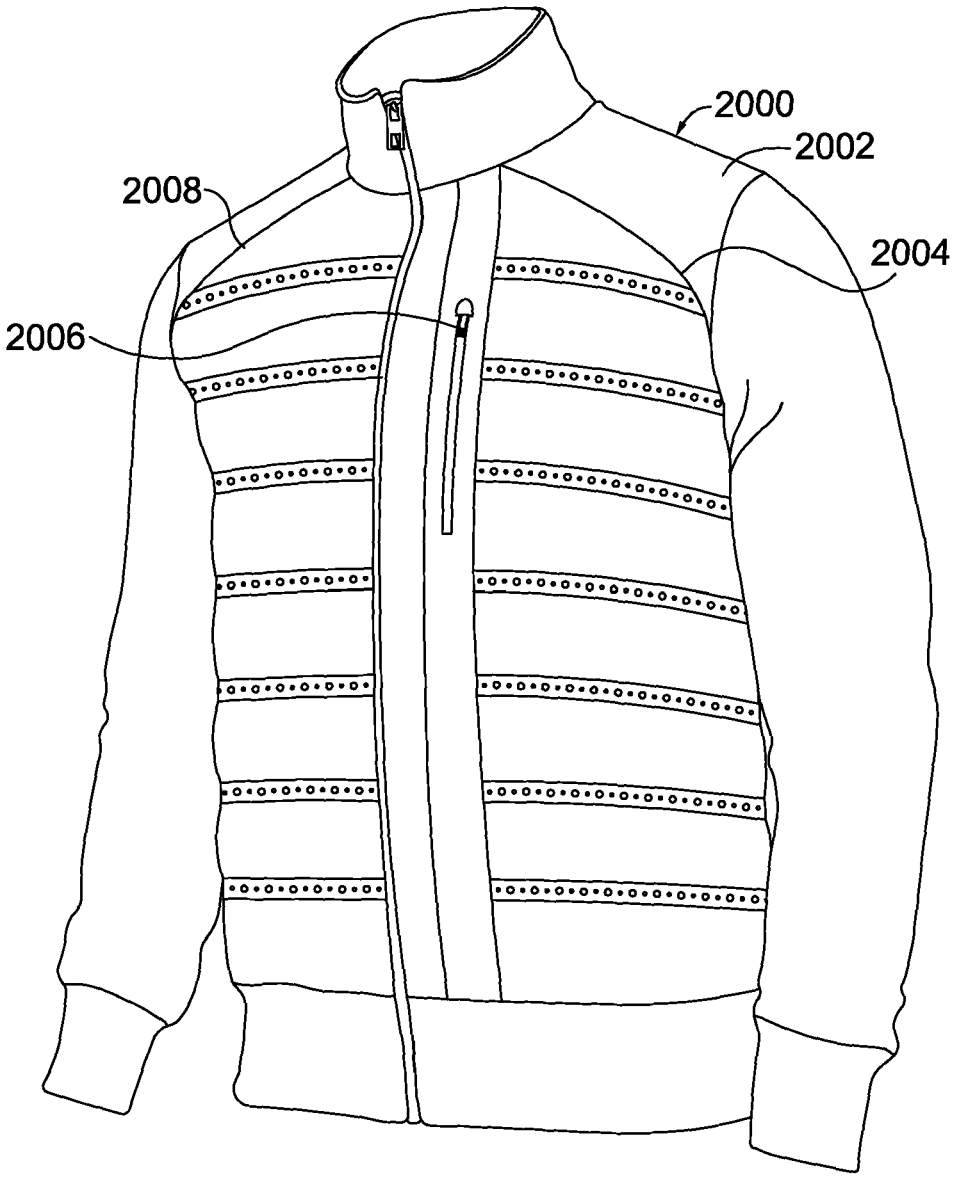
FIG. 20 is a front view of a vented fleece top with localized vented-insulation sections in accordance with the technology described herein.

Turning now to FIG. 20, insulation zones within a fleece top/jacket 2000 are shown, in accordance with an aspect of the technology described herein. The fleece jacket 2000 comprises a left-chest insulation zone 2004 and a right-chest insulation zone 2008. The body 2002 of the fleece jacket 2000 may comprise a breathable fleece material. A zipper 2006 can provide entrance to a pocket (not shown). The pocket can be constructed of mesh or another breathable material that works with the insulation zone 2004 to facilitate the transfer of heat and moisture through the fleece jacket 2000.

Figure 21:
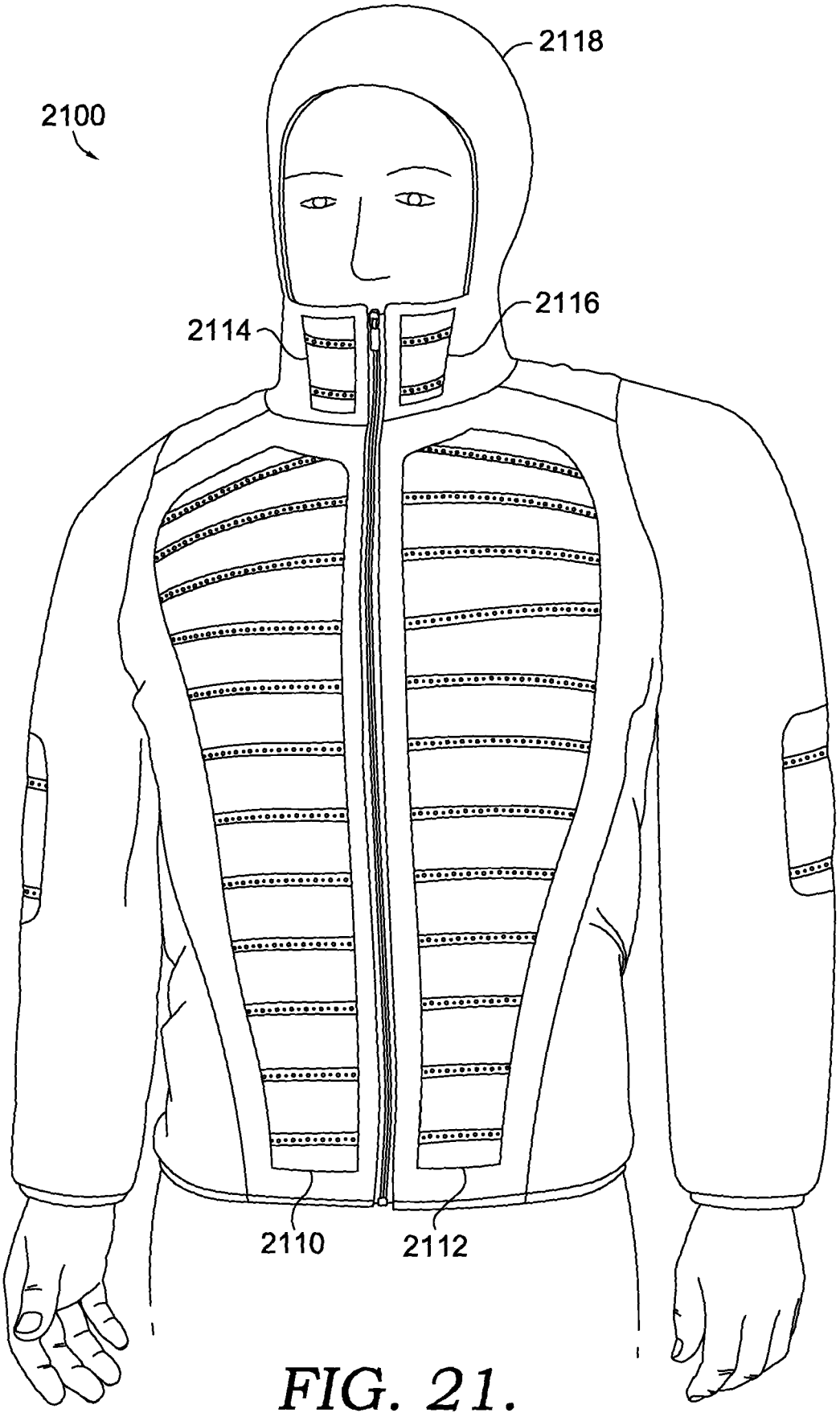
FIG. 21 is a front view of a vented jacket with a hood and localized vented-insulation sections in accordance with the technology described herein.

Turning now to FIG. 21, insulation zones within a hooded jacket 2100 are shown, in accordance with an aspect of the technology described herein. The hooded jacket 2100 comprises a left-chest insulation zone 2112 and a right-chest insulation zone 2110. The jacket 2100 may further comprise a hood 2118. The jacket 2100 also comprises a right-neck insulation zone 2114 and a left-neck insulation zone 2116, which might also align with a mouth and/or nose region of a wearer. As such, the right-neck insulation zone 2114 and the left-neck insulation zone 2116 might help to facilitate transfer of moisture, heat, and gas (e.g., carbon dioxide) away from a lower-face region of the wearer.

Figure 22:
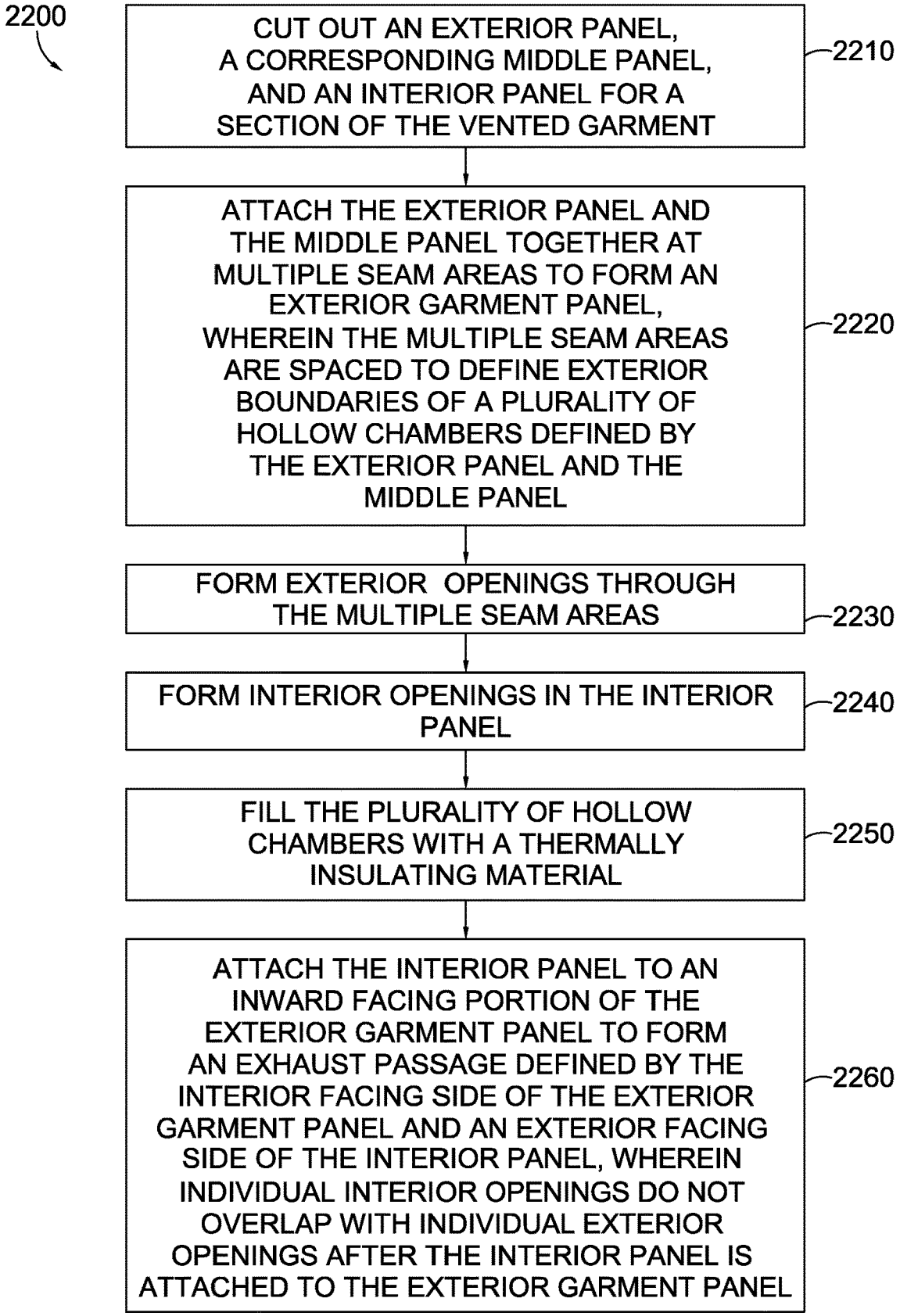
FIG. 22 is a flow chart showing an exemplary method of making a vented garment in accordance with the technology described herein

Turning now to FIG. 22, flow chart showing an exemplary method 2200 of making a vented garment is provided. The vented garment could be a jacket, a vest, pants, full body suit, and the like and may comprise any of the configurations as described herein. At step 2210, an exterior panel, a corresponding middle panel, and an interior panel are cut out for a section of the vented garment. In an aspect, this process is repeated for each section of the garment and the sections, once completed at step 2260, are then connected to form the final vented garment.

At step 2220, the exterior panel and the middle panel are attached together at multiple seams to form an exterior garment panel. The multiple seams are spaced to define boundaries of a plurality of hollow chambers defined by the exterior panel and the middle panel. The hollow chambers can be different sizes and shapes to provide varying levels of insulation.

At step 2230, exterior openings through the multiple seams are formed. The exterior openings may have varying numbers as well as different sizes and/or different shapes. The openings can be formed via, for example, laser cutting, water jet cutting, mechanical cutting, and the like. Alternatively, when the panels are formed though an engineered weaving or knitting process, the openings may be formed through the weaving or knitting process. At step 2240, interior openings in the interior panel are formed through any of the methods outlined above. The interior openings can have different sizes and different shapes.

At step 2250, the plurality of hollow chambers defined by the seams are filled with a thermally-insulating material, such as down or other synthetic fibers.

At step 2260, the interior panel is attached to an inward-facing portion of the outer or exterior garment panel at one or more areas to form an exhaust passage or space defined by the interior-facing side of the outer or exterior garment panel and an exterior-facing side of the interior panel. In an exemplary aspect, individual interior openings generally do not overlap with individual exterior openings after the interior panel is affixed to the outer or exterior garment panel. In other words, the interior openings or offset from the exterior openings. The exterior and interior openings are connected by the exhaust passages or space between the interior panel and the exterior garment panel.

In one aspect, one or more portions of the vented garment are constructed using an engineered weaving or knitting process (e.g., program a weaving or knitting machine to form these structures). For example, the exterior panels and the interior panels may be formed together through the knitting and weaving process, where the knitting or weaving process may be used to form the seams and/or the exterior and interior openings. Any and all aspects, and any variation thereof, are contemplated as being within the scope herein.

In an alternative method of manufacture, an exterior panel and a corresponding interior panel may be cut out for a section of a garment. Exterior openings may be formed in the exterior panel and interior openings may be formed in the interior panel. The exterior panel and the interior panel may be joined together at one or more seam areas to form an exterior garment panel. The panels may be joined together by, for example, stitching or bonding an upper part of the seam and stitching or bonding a lower part of the seam, where the areas between the stitched or bonded portions remain unaffixed. The exterior panel and the interior panel are positioned or aligned prior to the stitching or bonding process so that the interior openings are offset from the exterior openings at the seam areas and so that the interior openings and the exterior openings are in communication with each other via the unaffixed areas between the stitched or bonded areas.

The one or more seam areas define and delineate one or more chambers which may be filled with a natural or synthetic fill material. The spacing between adjacent seams, in turn, defines the size of the chamber formed between the adjacent seams. As such, the spacing between seams may be adjusted to provide varying levels of insulation for different portions of the garment. Moreover, the spacing, size, and/or number of the exterior openings and the interior openings may be adjusted to facilitate greater or lesser amounts of moisture vapor and/or air transport. For example, the size and number of openings may be increased, and the spacing between openings decreased, to provide a greater amount of moisture vapor and/or air transport, while the size and number of openings may be decreased, and the spacing between openings increased, to provide a lesser amount of moisture vapor and/or air transport. Further, these variables may be adjusted corresponding to where the openings are positioned on the resultant garment. For example, moisture vapor and/or heat transport may be greater on portions of the garment that overlay high heat and/or moisture producing areas of the body such as the back torso along the spine, the flank areas of the wearer the chest area, the thigh or shin areas, the upper arm areas of the wearer, and the like. Continuing, the variables associated with the openings may also be adjusted depending on whether the resultant garment will be used for a male or a female as heat and/or moisture transport needs may differ between males and females. Any and all aspects, and any variation thereof, are contemplated as being within the scope herein.

Alternative Aspects Having an Exterior Garment Assembly

FIGS. 1-22 depict a vented garment having chambers filled with insulating material formed, in part, from an exterior panel. However, it may be desirable for the vented garment to have an exterior garment assembly exterior to and positioned adjacent to the panels forming the chambers filled with insulating material. Utilizing an exterior garment assembly positioned exterior and adjacent to the interior garment assembly with insulation chambers may provide an additional layer of insulation and a more streamlined appearance when the insulating chambers are not visible when viewing the exterior of the garment. Just as with the vented garments depicted in FIGS. 1-22, offset openings may be used to create passages between the interior garment assembly and the exterior garment assembly to prevent moisture from being trapped within the garment. These passages provide an indirect route for heat and moisture vapor to travel from the interior of the garment proximate to the wearer's body to the external environment and, therefore, may provide ventilation and moisture management within an insulating garment.

The interior garment assembly may comprise two panels attached at one or more seams that at least partially define the edges of hollow chambers between the two panels. The chambers may be filled with thermally-insulating fill material to provide warmth while the seams may include a plurality of interior openings through which the moisture vapor and heat may escape from inside the garment. The exterior garment assembly may comprise one, or in some aspects two, panels and have a plurality of exterior openings. The interior garment assembly and exterior garment assembly may be affixed at one or more locations such that the interior openings are offset from the exterior openings. The exterior garment assembly and the interior garment assembly may be permanently attached to create a single garment or, in alternative aspects, may comprise discrete garments configured to be worn together, for example, with the exterior garment assembly positioned over the interior garment assembly. When worn together, the exterior garment assembly and the interior garment assembly create the passages for an indirect route by which heat and moisture vapor can escape to the outside environment.

As mentioned, some aspects of the exterior garment assembly include two panels, which provide additional insulation and strength to the exterior garment assembly. Like the interior garment assembly, the two panels of the exterior garment assembly may be attached along one or more seams with the exterior openings extending through both panels of the exterior garment assembly along the seams. Further, in some aspects, the seams may define edges of chambers between the two panels of the exterior garment assembly, and the chambers may optionally be filled with thermally-insulating material to increase insulation to the wearer.

Accordingly, aspects of the disclosure include a vented garment comprising an exterior garment assembly and an interior garment assembly. The exterior garment assembly has a first plurality of openings extending through the exterior garment assembly. The interior garment assembly comprises an interior panel and a first middle panel, the middle panel being positioned between the interior panel and the exterior garment assembly. The interior garment assembly also includes a second plurality of openings extending through one or more portions of the interior panel and the first middle panel. The exterior garment assembly is attached to the interior garment assembly at one or more locations that cause at least a portion of the first plurality of openings to be offset from at least a portion of the second plurality of openings. In some aspects, the exterior garment assembly comprises an exterior panel and a second middle panel attached along a plurality of seams. The first plurality of openings may extend through the exterior panel and the middle panel along one or more seams within the plurality of seams.

In another aspect, a vented apparel system includes an exterior garment panel comprising an exterior panel and an interior garment panel comprising an interior panel and a middle panel, where the middle panel is exterior to the interior panel. The exterior garment has a first plurality of openings extending through one or more portions of the exterior panel while the interior garment has a second plurality of openings extending through one or more portions of the interior panel and the middle panel. When the exterior garment is worn over the interior garment, the middle panel is positioned between the interior panel and the exterior panel, and at least a portion of the first plurality of openings are offset from at least a portion of the second plurality of openings. In some aspects, the exterior garment is configured to be releasably coupled to the interior garment.

A further aspect of the present disclosure includes a method of making a vented garment. The method includes providing an exterior panel, a middle panel, and an interior panel for at least a section of the vented garment. The interior panel and the middle panel are attached together at multiple seam areas to form an interior garment assembly. The multiple seam areas are spaced apart to define outer boundaries of a plurality of chambers defined by the interior panel and the middle panel. The method further includes forming a first plurality of openings extending through the exterior panel and forming a second plurality of openings extending through at least a portion of the multiple seam areas of the interior garment assembly. The plurality of chambers are filled with a thermally-insulating fill material, and the interior garment assembly is attached to an inward-facing portion of the exterior panel to form a passage defined by the inward-facing surface of the exterior panel and an outward-facing surface of the middle panel. When assembled, the individual openings of the first plurality of openings are offset from individual openings of the second plurality of openings.

Figure 23:
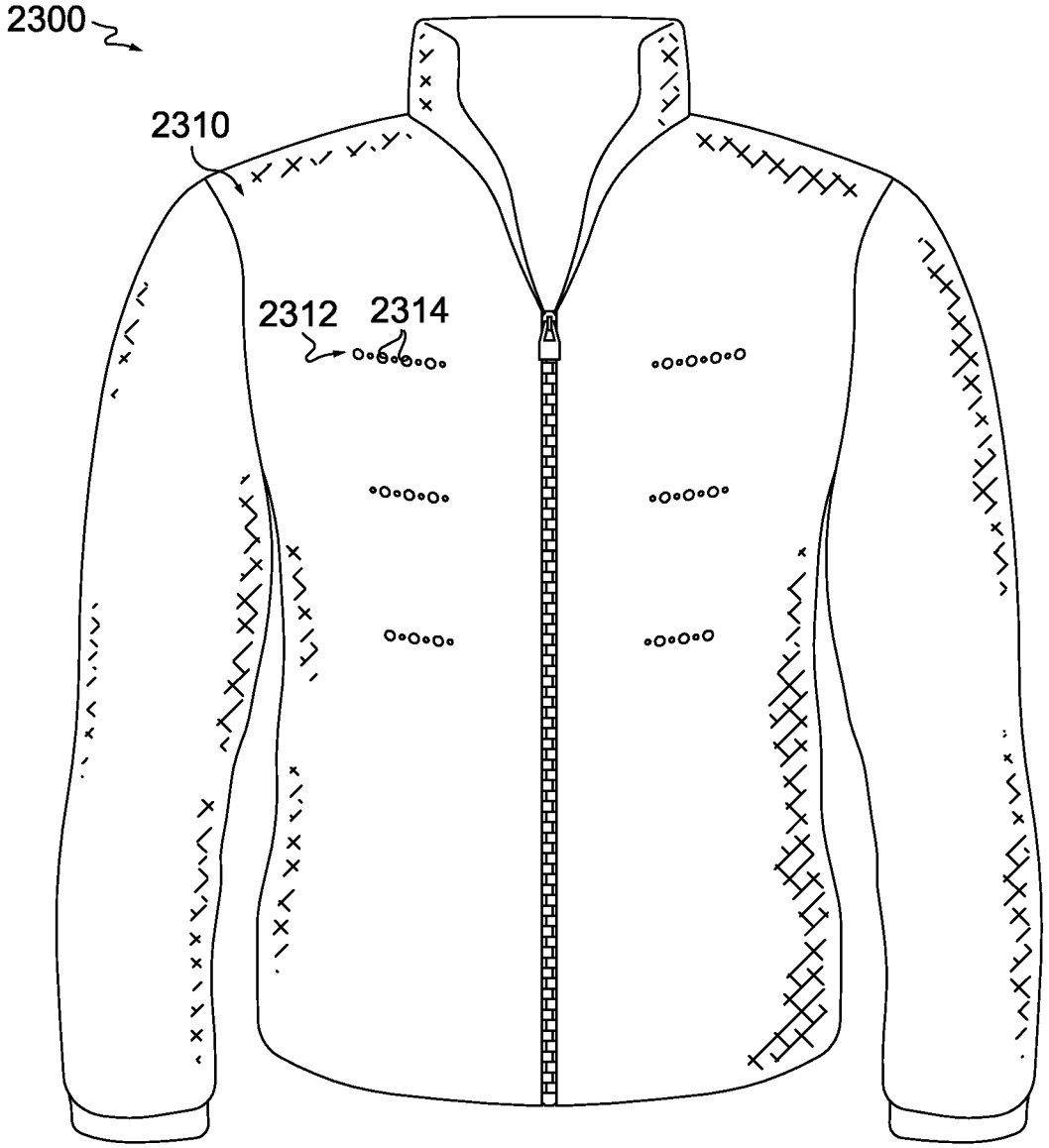
FIG. 23 is a front view of a vented garment in accordance with the technology described herein.
Figure 24:
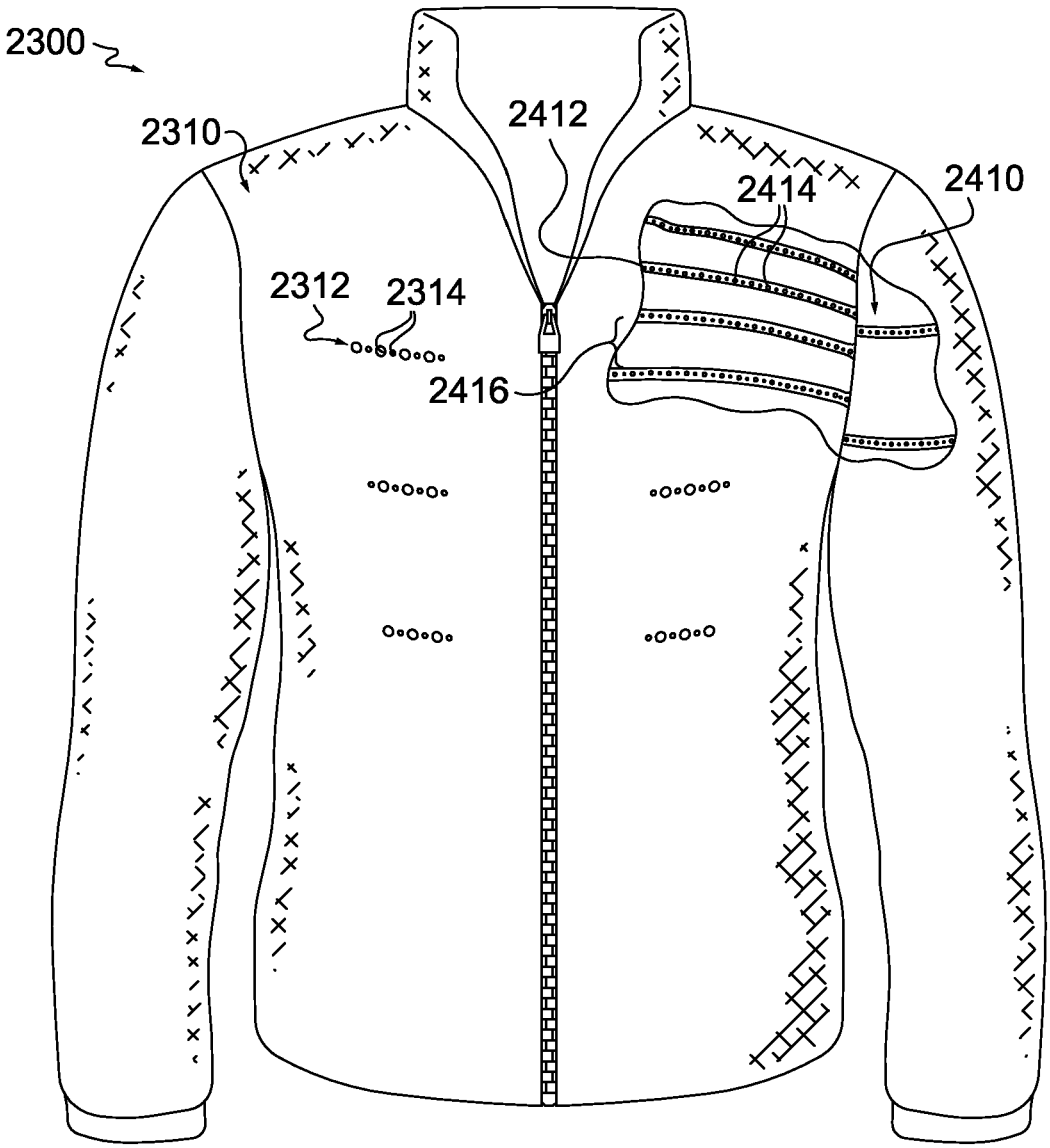
FIG. 24 is a front view of the vented garment of FIG. 23 with a portion removed to show an interior garment assembly in accordance with the technology described herein.

FIGS. 23 and 24 illustrate a front view of a vented garment 2300 in accordance with aspects of this alternative configuration. The garment 2300 may comprise an exterior garment assembly 2310 forming an exterior layer of the garment 2300. As shown in FIG. 24, which provides a front view of the garment 2300 with a portion of the exterior garment assembly 2310 removed, the garment 2300 may also comprise an interior garment assembly 2410 positioned interior to the exterior garment assembly 2310 when the garment 2300 is in an assembled configuration.

In the aspect illustrated, the vented garment 2300 comprises a jacket configured to cover a wearer's upper body when worn. It is contemplated, however, that the vented garment 2300 may take other forms, such as a vest, a body suit, pants, and the like. Additionally, the exterior garment assembly 2310 and the interior garment assembly 2410 may be the same or different forms. For instance, FIGS. 23 and 24 illustrate an exterior garment assembly 2310 being a jacket and, though not shown in its entirety, the interior garment assembly 2410 may also comprise a jacket. But in alternative aspects, for example, the exterior garment assembly 2310 may be a jacket with sleeves while the interior garment assembly 2410 may comprise a vest. In other words, the interior garment assembly 2410 may be configured to be positioned underneath only one or more portions of the exterior garment assembly 2310, as in the case of an exterior garment assembly 2310 being a jacket and an interior garment assembly 2410 being a vest. Similarly, the exterior garment assembly 2310 may be configured to cover only one or more portions or regions of the interior garment assembly 2410, such as when the exterior garment assembly 2310 is a vest and the interior garment assembly 2410 is a jacket with sleeves.

Additionally, in some aspects, either the exterior garment assembly 2310 or the interior garment assembly 2410 are not, by themselves, a fully-formed apparel item but, instead, form one or more portions of the vented garment 2300. For instance, the exterior garment assembly 2310 and/or the interior garment assembly 2410 may be located in parts of the vented garment 2300 to form vented insulation zones, similar to the zones described with respect to FIGS. 9-21. The zones may be located to maximize the retention of heat while allowing for moisture venting. For instance, zones made up of the exterior garment assembly 2310 and the interior garment assembly 2410 may be positioned in vented garment 2300 in areas corresponding to the wearer's chest, shoulders, upper arms, back, thighs and the like.

The exterior garment assembly 2310 and the interior garment assembly 2410 may be constructed from a variety of textile materials. The textile materials used may generally comprise knitted materials, woven materials, or a combination of knitted or woven materials. Materials for the exterior garment assembly 2310 and/or the interior garment assembly 2410 may be fabrics treated with down-proof chemical treatments and/or may be fabrics having wind resistant and/or water resistant properties. One exemplar fabric includes a textile treated with a water repellant that also act as down-proofing treatment, such as durable water repellant (DWR). In addition to waterproofing the fabric, DWR may be used for down-proofing fabrics, especially light and ultra-light weight fabrics. For example, fabrics that may particularly benefit from DWR treatment for down proofing are light fabrics (89 gram per square meter to 30 gram per square meter) and ultra-light fabrics (29 gram per square meter or lighter) because it provides more resistance to tearing that can be caused by down having sharp shafts and is less susceptible to loss of fill material. Heavier fabrics, such as fabrics with weights in the range of gram per square meter to 149 gram per square meter or even 150 gram per square meter to 250 gram per square meter or higher, may be inherently more resistant to down and may or may not need a down-proofing treatment depending on the specific type of fabric but, in some aspects, still include treatments to impart water and/or wind-resistant properties. Both heavy and light-weight fabrics may be used in garments in accordance with the technology described herein.

As previously mentioned, in some aspects, fill material is used only in chambers within the interior garment assembly 2410. In such case, only the interior garment assembly 2410 may be constructed from down-proof treated fabrics as the exterior garment assembly 2310 may retain structural integrity without the down-proof treated fabrics. Even when the exterior garment assembly 2310 does not include chambers with fill material, it may be desirable, nonetheless, to use a water-proofing treatments, such as DWR, for the exterior garment assembly 2310 to provide weather resistant characteristics.

Turning to FIG. 24, the interior garment assembly 2410 may be similar in construction to the vented garment 100 depicted in FIG. 1 in that it comprises two panels (shown in FIG. 25) coupled together along one or more seams 2412. The seams 2412 define or delineate one or more edges of chambers, such as chamber 2416 between each seam 2412. The chambers 2416 may be filled with thermally-insulating fill material. Exemplary thermally-insulating fill material may comprise synthetic fibers, synthetic fill, or down.

Similar to seams 120 discussed with respect to FIG. 1, the seams 2412 in vented garment 2300 may formed by placing adhesive in sections of one or both panels of the interior garment assembly 2410 and pressing the panels together along the sections with adhesive with sufficient force and/or applied energy to activate the adhesive. Alternatively, in some aspects, the seams 2412 are created by stitching together the two panels along one or more portions of the seams 2412. The seams 2412 may also be formed with adhesive and then reinforced with stitching along the upper boundaries and/or lower boundaries of the seams 2412.

Additionally, similar to seams 120, the seams 2412 may be spaced apart in a generally horizontal orientation on the garment 2300 as shown in FIG. 24. It is also contemplated, however, that the seams 2412 may be spaced apart in a generally vertical orientation or a generally diagonally orientation. In some aspects, the seams comprise a more organic curve or shape. The spacing of seams 2412 may vary, as may the relative orientation of the seams 2412 and/or the shape of the seams 2412, enabling the chambers 2416 to be different shapes and/or sizes. The spacing of the seams 2412 may be determined from the desired size of the chambers 2416 for thermally-insulating fill material. Similarly, in some aspects, the spacing between adjacent seams 2412 may be variable depending upon the desired amount of insulation needed at different portions of the garment 2300. For instance, less insulation may be needed at high heat-producing areas, such as the back and chest, thereby requiring less spacing between seams 2412 in those areas. Exemplary distances between adjacent seams 2412 may comprise, for example, between 1 centimeter and 20 centimeter, between 2 centimeter and 15 centimeter, and/or between 3 centimeter and 10 centimeter, although ranges above and below these values are contemplated herein.

The seams 2412 may be perforated to provide a plurality of interior openings 2414 along the seams 2412 (the openings 2414 are labelled as "interior openings" to convey that they are positioned interior to the exterior garment assembly 2310). The plurality of interior openings 2414 may provide ventilation and moisture management by allowing heat and/or perspiration to escape to a space between the interior garment assembly 2410 and the exterior garment assembly 2310. The location of the interior openings 2414 along the seams 2412 may vary in different aspects. For example, the interior openings 2414 may be evenly spaced along the entirety of each seam 2412. In other aspects, a higher density of interior openings 2414 may be localized to certain portions of the garment 2300 corresponding to high-heat producing regions of a wearer, such as the chest, the under arms, the neck, and the back. Additionally, the size and/or shape of the interior openings 2414 may either be uniform or may vary. The interior openings 2414 illustrated in FIG. 24, for instance, each comprise a circular shape but alternate between larger and smaller circles.

In addition to the interior openings 2414, the vented garment 2300 may include a plurality of exterior openings 2314 as shown in FIGS. 23 and 24 (the openings 2314 are labelled as "exterior openings" to convey that they are in communication with, for instance, the external environment). The exterior garment assembly 2310, for instance, may comprise one or more venting areas 2312 that are perforated to provide a plurality of exterior openings 2314 extending through the exterior garment assembly 2310. Like the seams 2412 on the interior garment assembly 2410, the venting areas 2312 may be various orientations and utilize various spacing patterns, such as those discussed with respect to the seams 2412. In some aspects, the orientation and/or spacing pattern of the venting areas 2312 on the exterior garment assembly 2310 are the same as the seams 2412 on the interior garment assembly while, in other aspects, the venting areas 2312 and the seams 2412 comprise different orientations and/or spacing patterns. Similarly, the exterior openings 2314 may be of various sizes and shapes and utilize various spacing patterns, such as those discussed with respect to the interior openings 2414 on the interior garment assembly 2410. In some aspects, the sizes, shapes, and/or spacing patterns of the exterior openings 2314 are the same as the interior openings 2414 while, in other aspects, the exterior openings 2314 and the interior openings 2414 comprise different orientations and/or spacing patterns.

The exterior garment assembly 2310 may be attached to the interior garment assembly 2410 at one or more locations that causes at least a portion of the exterior openings 2310 to be offset from at least a portion of the interior openings 2414 when the exterior garment assembly 2310 is attached to the interior garment assembly 2410. The offset nature of the exterior openings 2314 and the interior openings 2414 creates passages that allow for an indirect flow of air from the inside of the garment 2300 (i.e., the area proximate to the wearer's body) to the external environment. These passages allow for ventilation and moisture management without providing a direct passage for air from the outside environment to enter into the inside of the garment 2300.

In some aspects, the distribution of the exterior openings 2314 in the exterior garment assembly 2310 and the interior openings 2414 in the interior garment assembly 2410 may be configured such that all of the exterior openings 2314 are offset from the interior openings 2414 and there is no overlap between any of the exterior openings 2314 and the interior openings 2414. In other aspects, however, a portion of the exterior openings 2314 overlap with a portion of the interior openings 2414 such that there is some direct air flow from the inside of the garment 2300 to the external environment. It is contemplated that between 0% to 50% of the openings may overlap. Additionally, an exterior opening 2314 may partially or completely overlap with an interior opening 2414. For instance, an exterior opening 2314 may be aligned with an interior opening 2414 such that all of the exterior opening 2314 overlaps with the interior opening 2414, or an exterior opening 2314 and an interior opening 2414 may partially align such that only half of the exterior opening 2314 overlaps with the interior opening 2414. The amount of overlap between a particular exterior opening 2314 and an interior opening 2414 may be consistent among all the overlapping exterior openings 2314 and interior openings 2414. Alternatively, the amount of overlap may vary. Openings in higher heat-producing areas, for example, may include more overlap to provide a larger path for direct air flow than openings in lower heat-producing areas.

Figure 25:
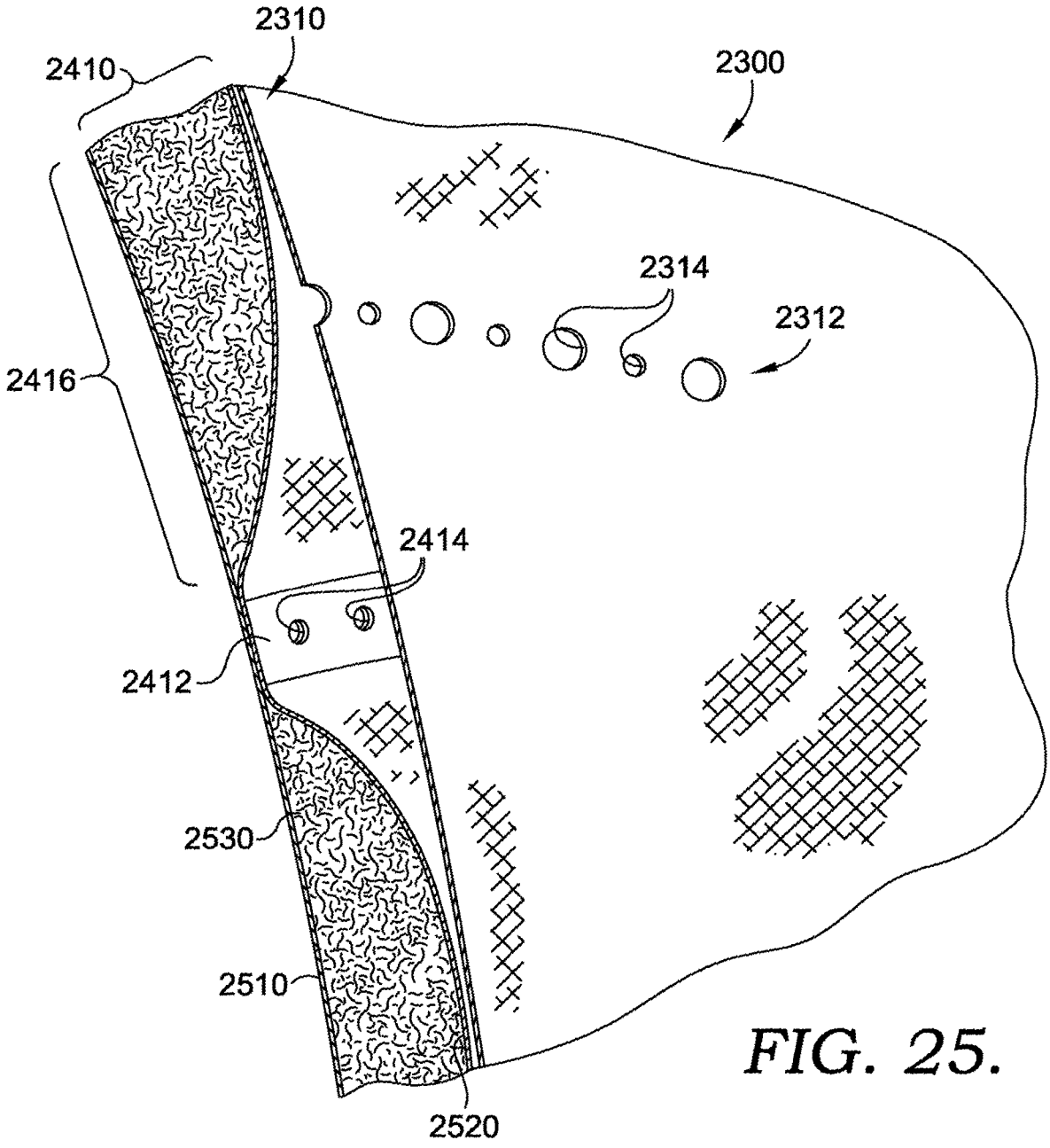
FIG. 25 is a perspective, close-up view of a section of the vented garment of FIG. 23 in accordance with the technology described herein.

FIG. 25 provides a close-up view of a section of the vented garment 2300, showing the exterior openings 2314 being offset from the interior openings 2414. The interior garment assembly 2410 may include an interior panel 2510 and a middle panel 2520 that is positioned exterior to the interior panel 2510. When the interior garment assembly 2410 is attached or otherwise worn with the exterior garment assembly 2310, the middle panel 2520 may be positioned between the interior panel 2510 and the exterior garment assembly 2310. The interior panel 2510 and the middle panel 2520 are affixed together along one or more seams 2412. The seams 2412 may, in part, delineate and define the chambers 2416 that are filled with thermally-insulating fill material 2530, such as down or synthetic fibers or fill. The seams 2412 may also be at least partially defined by the interior panel 2510 and the middle panel 2520. The seams 2412 include interior openings 2414 that extend through the interior panel 2510 and the middle panel 2520.

The exterior garment assembly 2310 with the plurality of exterior openings 2314 may be positioned adjacent and exterior to the interior garment assembly 2410 so that the exterior openings 2314 are offset from the interior openings 2414. In other words, the exterior openings 2314 are not axially aligned and do not overlap with the interior openings 2414 when the exterior garment assembly 2310 and the interior garment assembly 2410 are attached or worn together. In this way, the exterior openings 2314 are not in direct communication with the environment interior to the vented garment 2300, and the interior openings 2414 are not in direct communication with the exterior environment.

Figure 26:
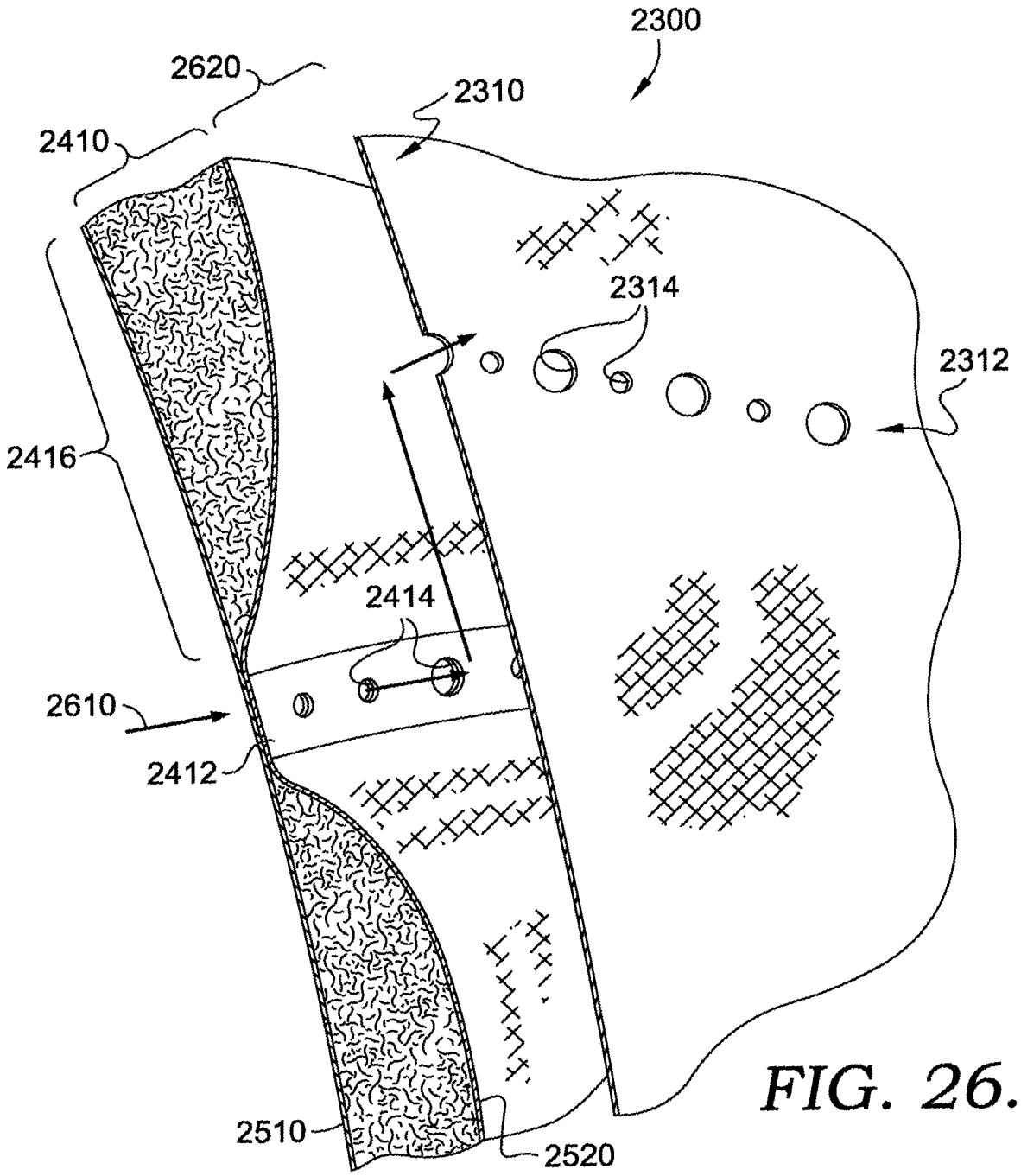
FIG. 26 is a partially exploded, close-up view of the vented garment of FIG. 25 in accordance with the technology described herein.

Offsetting the exterior openings 2314 from the interior openings 2414 causes moisture vapor and/or heat exiting the garment 2300 to traverse a passage between the interior garment assembly 2410 and the exterior garment assembly 2310, which is shown by the partially exploded view of the section of the garment 2300 in FIG. 26. As previously described, the garment 2300 is formed, in part, by fixing the exterior garment assembly 2310 to the interior garment assembly 2410 that comprises the interior panel 2510 and the middle panel 2520 positioned between the interior panel 2510 and the exterior garment assembly 2310. In aspects, though the exterior garment assembly 2310 may be affixed to the interior garment assembly 2410 at one or more locations, the exterior garment assembly 2310 and the interior garment assembly 2410 may remain unattached in at least the area between a seam 2412 on the interior garment assembly 2410 and an adjacent venting area 2312 on the exterior garment assembly 2310. A space or passage 2620 is thereby maintained between an inward-facing surface of the exterior garment assembly 2310 and an outward-facing surface of the middle panel 2520 of the interior garment assembly 2410. As shown by the arrows 2610, moisture vapor and/or heat may travel from the inside the garment 2300 proximate to the wearer's body through the interior openings 2414 in the seam 2412, traverse the passage or space 2620 between the middle panel 2520 and the exterior garment assembly 2310, and exit via the exterior openings 2314 in the exterior garment assembly 2310.

Although not shown, some aspects of the vented garment 2300 further include a liner panel positioned adjacent to an inward-facing surface of the interior panel 2510. The liner panel may comprise a mesh material, a moisture wicking material, and/or a moisture managing fabric. The liner panel may include one or more openings that are either offset from or aligned with the interior openings 2414 to maintain air flow.

Figure 27:
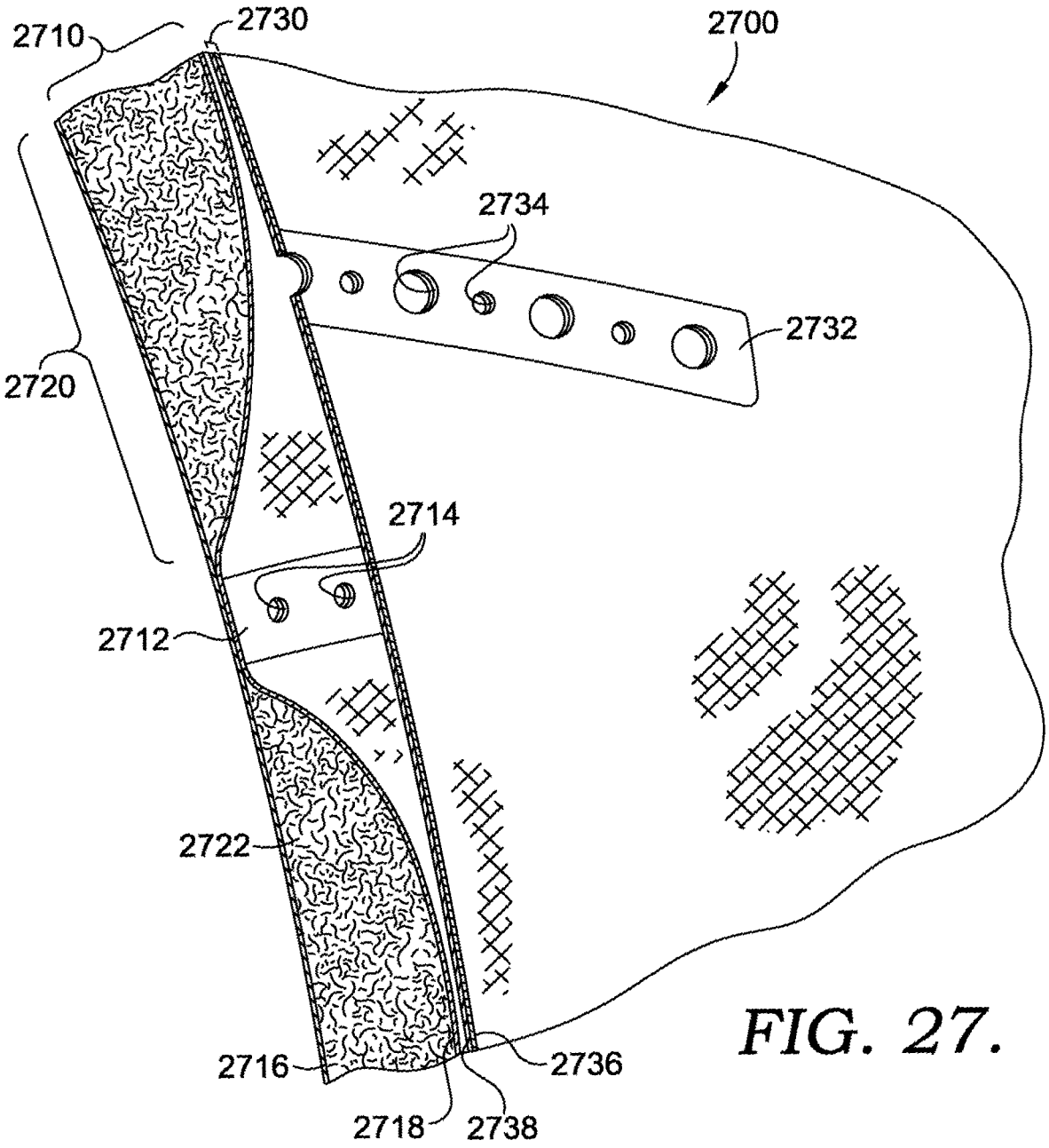
FIG. 27 is a perspective, close-up view of a section of a vented garment in accordance with the technology described herein.

In an alternative aspect depicted in FIG. 27, a vented garment 2700 comprises an interior garment assembly 2710 and an exterior garment assembly 2730 that both comprise at least two panels. As shown in FIG. 27, the interior garment assembly 2710 may be substantially identical to the interior garment assembly 2410 depicted in and described with respect to FIGS. 24-26. Specifically, the interior garment assembly 2710 may comprise an interior panel 2716 attached to a first middle panel 2718 at one or more seams 2712 that define chambers 2720 with thermally-insulating fill material 2722. A plurality of interior openings 2714 may extend through the interior panel 2716 and the first middle panel 2718 along the seams 2712.

Similarly, the exterior garment assembly 2730 may comprise an exterior panel 2736 and a second middle panel 2738 in accordance with this alternative aspect. The exterior panel 2736 may form the outermost panel of the vented garment 2700, and the second middle panel 2738 may be positioned between the exterior panel 2736 and the first middle panel 2718 when the exterior garment assembly 2730 and the interior garment assembly 2710 are attached or worn together. The exterior panel 2736 may be attached to the second middle panel 2738 at one or more seams 2732. The seams 2732 may include a plurality of exterior openings 2734 that extend through the exterior panel 2736 and the second middle panel 2738. The seams 2732 may have various orientations and spacing patterns, such as those discussed with respect to the seams 2412 of FIGS. 24-26.

Figure 28:
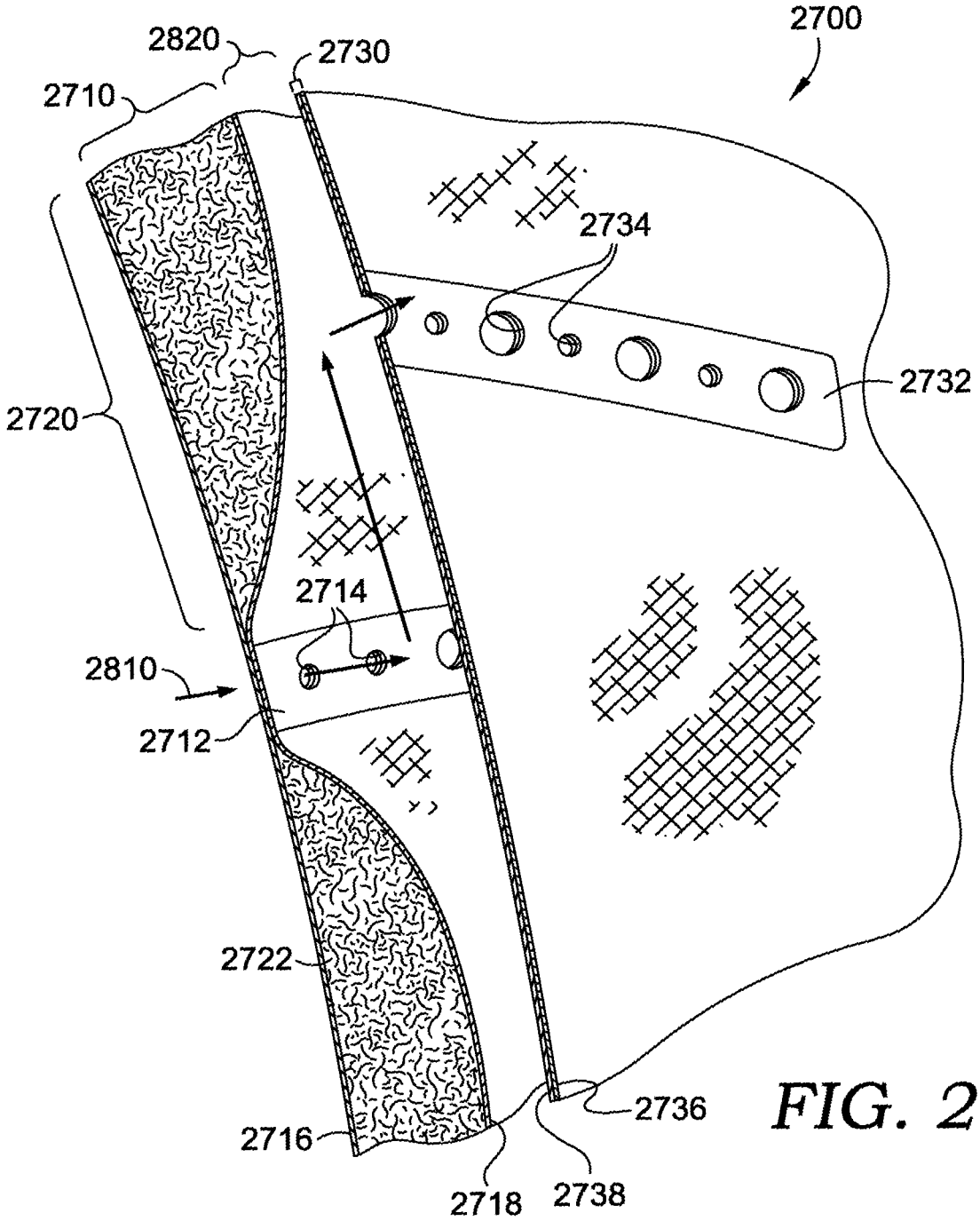
FIG. 28 is a partially exploded, close-up view of the section of the vented garment of FIG. 27 in accordance with the technology described herein.

FIG. 28 illustrates an exploded view of the section of the vented garment 2700. Similar to the aspects illustrated in FIGS. 25-26, a space or passage 2820 is maintained between the first middle panel 2718 of the interior garment assembly 2710 and the second middle panel 2738 of the exterior garment assembly 2730. As shown by the arrows 2810, moisture vapor and/or air may travel from the wearer's body through the interior openings 2714 in the seam 2712 of the interior garment assembly 2710, traverse the passage or space 2820 between the first middle panel 2718 and the second middle panel 2738, and exit via the exterior openings 2734 in the seam 2732 of the exterior garment assembly 2730.

By forming the exterior garment assembly 2730 from two panels (i.e., the exterior panel 2736 and the second middle panel 2738, more insulation and structure may be imparted to the vented garment 2700. Additionally, although not illustrated, some aspects of the double-paneled exterior garment assembly contain thermally-insulating fill material to further increase the amount of insulation provided to the wearer. Specifically, the seams 2732 attaching the exterior panel 2736 and the second middle panel 2738 may at least partially define chambers, similar to the chambers 2720 of the interior garment assembly 2710. The chambers of the exterior garment assembly 2730 may contain fill material, such as down or synthetic fill, to increase insulation. In some aspects, only a portion of the seams 2732 of the exterior garment assembly 2730 define chambers for thermally-insulating fill material, depending on the need for additional insulation in those areas. For instance, in some aspects, the exterior garment assembly 2730 includes chambers with thermally-insulating fill material in portions corresponding to low heat-producing areas, such as the wearer's appendages, while lacking chambers in the portions corresponding to high heat-producing areas, such as the wearer's underarms, back, and neck.

Figure 29:
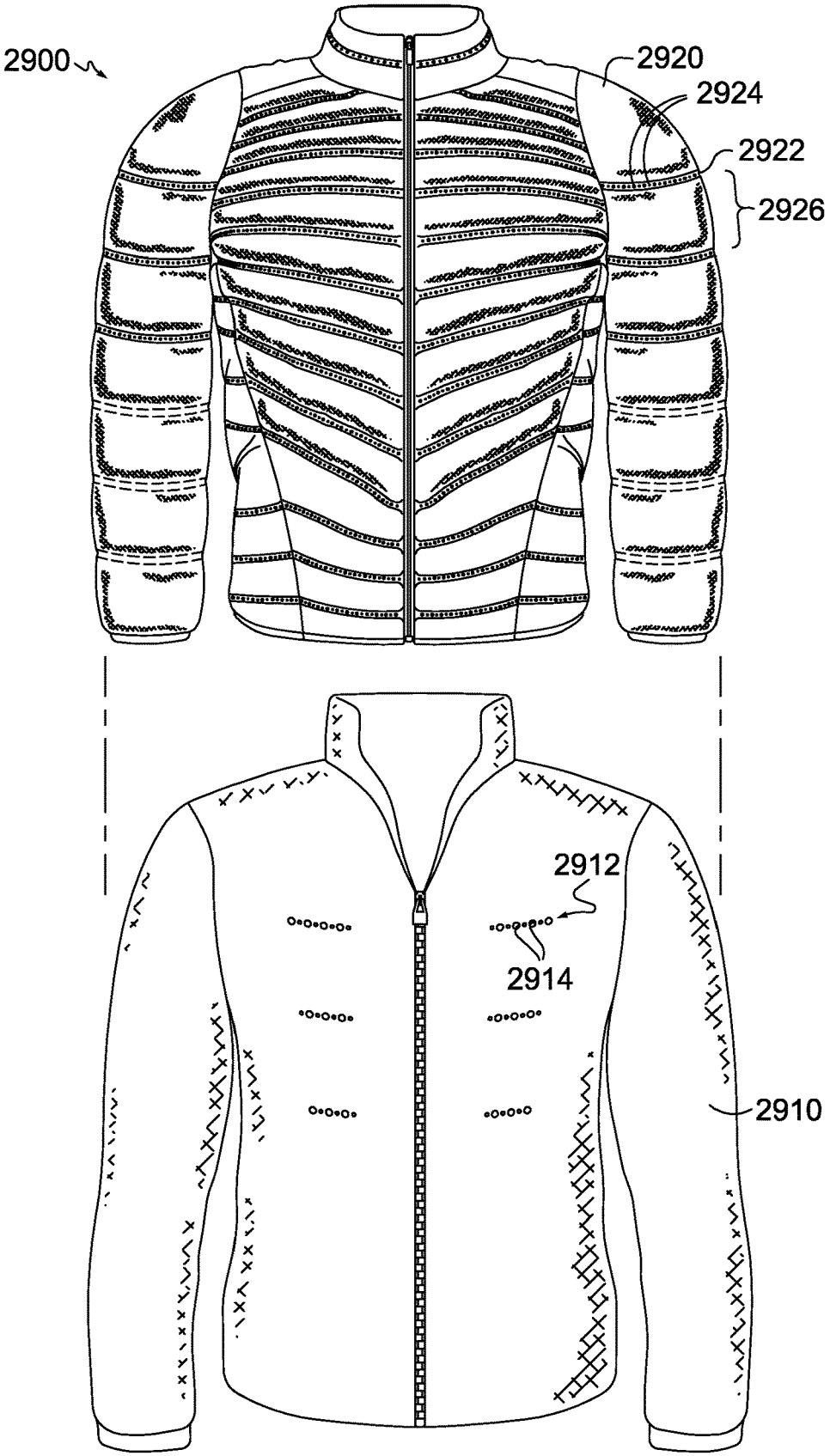
FIG. 29 is an exploded view of a vented apparel system in accordance with the technology described herein.

Turning to FIG. 29, a vented garment system 2900 is depicted in accordance with aspects of the technology. While some aspects of the technology described herein comprise a singular vented garment, such as garment 2300, with an exterior garment assembly 2310 permanently affixed to the interior garment assembly 2410, FIG. 29 shows an exterior garment 2910 and an interior garment 2920 that together, form the vented garment system 2900. The exterior garment 2910 and the interior garment 2920 may be configured to each be worn separately or in conjunction. For instance, a wearer may wear the interior garment 2920 and then put on the exterior garment 2910 over the interior garment 2920 when more warmth is needed. The interior garment 2920 may be substantially similar to the interior garment assembly 2410 of FIGS. 24-26, having two panels attached at one or more seams 2922 that at least partially define chambers 2926 with thermally-insulating fill material and having a plurality of interior openings 2924 only the seams 2922. The exterior garment 2910 may be substantially similar to the exterior garment assembly 2310 of FIGS. 23-26, having one or more venting areas 2912 with a plurality of exterior openings 2914 extending through the exterior garment 2910. Alternatively, the exterior garment 2910 may be similar to the exterior garment assembly 2730 of FIGS. 27-28, having two panels affixed at seams through which the plurality of exterior openings 2914 extend.

The exterior garment 2910 may be positioned over the interior garment 2920 without being coupled or otherwise affixed together. In some aspects, however, the exterior garment 2910 may be releasably coupled to the interior garment 2920 via one or more releasable coupling mechanisms. Such releasable coupling mechanisms may include buttons, snap closures, zipper mechanisms, hook-and-loop fasteners, and the like.

When worn by itself, each of the exterior garment 2910 and the interior garment 2920 provide ventilation and moisture management to the wearer because the exterior garment 2910 and the interior garment 2920 include the exterior openings 2914 and the interior openings 2924, respectively. When the garments are worn alone, the exterior openings 2914 and the interior openings 2924 each provide a direct air passage from the interiors of the exterior garment 2910 and interior garment 2920, respectively, to the exterior environment. When the exterior garment 2910 is worn over the interior garment 2920, however, an indirect passage for heath and/or moisture vapor is provided. That is, just as with vented garments 2300 and 2700, the exterior openings 2914 are positioned on the exterior garment 2910 and the interior openings 2924 are positioned on the interior garment 2920 such that the exterior openings 2914 are offset from the interior openings 2924 when the exterior garment 2910 is worn over the interior garment 2920.

Figure 30:
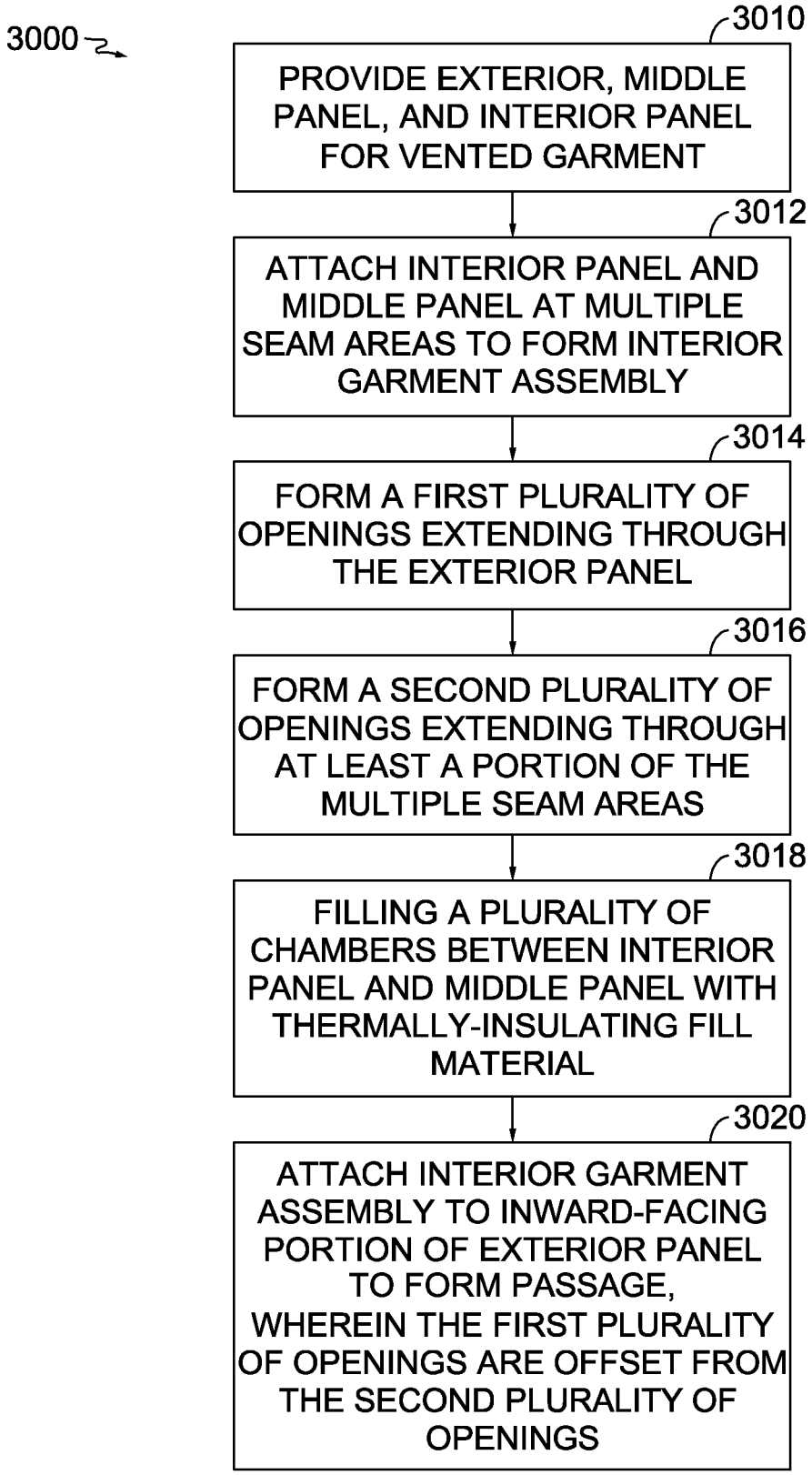
FIG. 30 is a flow chart illustrating a method of manufacturing a vented garment in accordance with the technology described herein.

Turning now to FIG. 30, a flow chart showing a method 3000 of making a vented garment is provided. The vented garment may be a jacket, a vest, pants, body suit, and the like and may comprise any of the configurations as described herein. At step 3010, an exterior panel, a corresponding middle panel, and an interior panel are provided for the vented garment. This step 3010 may include cutting or otherwise forming these panels for a section of the vented garment. In aspects in which the vented garment comprises multiple sections, this step is repeated for each section and each section is attached to form the final garment.

At step 3012, the interior panel and the middle panel are attached together at multiple seam areas to form an interior garment assembly. The multiple seam areas are spaced to define boundaries of a plurality of chambers defined by the interior panel and the middle panel. The chambers can be different sizes and shapes to provide varying levels of insulation. In some aspects, attaching the interior panel and the middle panel together at the multiple seam areas includes applying an adhesive along pre-defined sections of one or more of the interior panel and the middle panel, the sections being pre-defined by the desired locations of the seams. The adhesive may be applied to an inward-facing surface of the middle panel and/or to an outward-facing surface of the interior panel. Once the adhesive is in place, the interior panel may be aligned with the middle panel such that the adhesive is positioned between the interior panel and the middle panel. The interior panel and the middle panel may be pressed together with sufficient force and/or with sufficient energy applied to activate the adhesive to bond the interior panel and the middle panel together along the sections. The adhesive may be activated by, for instance, heat, ultrasonic energy, or any other type of applied energy. Once bonded, the seams are formed to at least partially define the chambers along with the interior and middle panels.

In alternative aspects, the multiple seam areas are created without adhesive. For example, interior panel and the middle panel may be formed form a fabric with fibers that are reactive to stimuli, such as heat, sound waves, mechanical pressure, chemicals, water, and the like. The stimulus may be applied to the pre-determined sections of the interior panel and the middle panel to create the seam areas. Additionally, the multiple seam areas may be created by other methods of selectively affixing the interior and middle panels, such as stitching. Stitching may also be done in addition to using adhesive or any of bonding method described herein to provide reinforcement along the upper and/or lower boundaries of the seam area.

Continuing with method 3000, at step 3014, a first plurality of openings are formed such that they extend through the exterior panel, and at step 3016, a second plurality of openings are formed in at least a portion of the multiple seam areas of the interior garment assembly. The second plurality of openings extend through the interior panel and the middle panel and may be formed during bonding or after the interior and middle panels are attached. The first plurality of openings and the second plurality of openings may have varying numbers of openings as well as different sizes and/or different shapes. The openings within the first plurality of openings and the second plurality of openings may be formed via, for example, laser cutting, water jet cutting, mechanical cutting, and the like. Alternatively, when the panels are formed though an engineered weaving or knitting process, the openings may be formed through the weaving or knitting process.

At step 3018, the plurality of chambers defined by the interior and middle panel are filled with a thermally-insulating fill material, such as down or other synthetic fibers. Filling the chambers with fill material may occur before or after the second plurality of openings are formed along the multiple seam areas. At step 3020, the interior garment assembly is attached to an inward-facing portion of the exterior panel to form an exhaust passage defined by the inward-facing surface of the exterior panel and an outward-facing surface of the middle panel. The interior garment assembly is attached to the exterior panel in a way so that the individual openings of the first plurality of openings are offset from and do not overlap with individual openings of the second plurality of openings. The exterior and interior openings are connected by the exhaust passages or space between the middle panel and the exterior panel.

It will be understood that certain features and subcombinations are of utility and may be employed without reference to other features and subcombinations. This is contemplated by and is within the scope of the claims. Since many possible embodiments may be made of the technology described herein without departing from the scope thereof, it is to be understood that all matter herein set forth or shown in the accompanying drawings is to be interpreted as illustrative and not in a limiting sense.

The invention claimed is:

1. An upper body vented garment configured to cover a core area of a wearer, the upper body vented garment comprising:

an interior panel having a plurality of interior openings that extend through the interior panel; and an insulated panel comprising a middle panel and an exterior panel joined to each other along a plurality of seams, wherein the middle panel is located between the interior panel and the exterior panel, wherein one or more seams of the plurality of seams have a plurality of exterior openings that extend through the one or more seams of the plurality of seams, wherein each of the plurality of seams comprises a seam width that extends between a first seam edge and a second seam edge, and wherein each of the plurality of exterior openings are positioned between the first seam edge and the second seam edge of the one or more seams, wherein the interior panel is attached to the insulated panel at one or more locations, wherein the interior panel and the insulated panel are spaced apart at an area where the interior panel and the insulated panel are not attached, wherein at least a first portion of the plurality of interior openings is offset from at least a second portion of the plurality of exterior openings in the area where the interior panel and the insulated panel are not attached to each other, and wherein at least one indirect passage fluidly connects the plurality of interior openings and the plurality of exterior openings in the area where the interior panel and the insulated panel are not attached to each other.

2. The upper body vented garment of claim 1, wherein the exterior panel and the interior panel comprise a textile that weighs 89 g/m2 or less.

3. The upper body vented garment of claim 1, further comprising:

a chamber defined by the middle panel, the exterior panel, and a seam of the plurality of seams; and a thermally-insulating fill material contained within the chamber.

4. The upper body vented garment of claim 3, wherein the thermally-insulating fill material comprises one or more of synthetic fiber and down.

5. The upper body vented garment of claim 1, wherein the plurality of seams are further reinforced by stitching.

6. The upper body vented garment of claim 1, wherein the plurality of seams are created with an adhesive activated by an application of energy.

7. The upper body vented garment of claim 1, wherein the plurality of interior openings are offset from the one or more seams of the plurality of seams.

8. An upper body garment comprising:

at least one front panel and a back panel having a vented-insulation section that comprises:

an interior panel having a plurality of interior openings that extend through the interior panel; and an insulated panel comprising a middle panel and an exterior panel joined to each other along a plurality of seams, wherein the middle panel is located between the interior panel and the exterior panel, wherein one or more seams of the plurality of seams have a plurality of exterior openings that extend through the one or more seams of the plurality of seams, wherein each of the plurality of seams comprises a seam width that extends between a first seam edge and a second seam edge, and wherein each of the plurality of exterior openings is positioned between the first seam edge and the second seam edge of the one or more seams, wherein the interior panel is attached to the insulated panel at one or more locations, wherein the interior panel and the insulated panel are spaced apart at an area where the interior panel and the insulated panel are not attached to each other, wherein at least a first portion of the plurality of interior openings of the interior panel is offset from at least a second portion of the plurality of exterior openings of the insulated panel, and wherein at least one indirect passage fluidly connects the first portion of the plurality of interior openings and the second portion of the plurality of exterior openings in the area where the interior panel and the insulated panel are not attached to each other.

9. The upper body garment of claim 8, wherein the interior panel and the exterior panel comprise a fabric/textile that weighs 89 g/m2 or less.

10. The upper body garment of claim 8, the vented-insulation section further comprising:

a chamber defined by the middle panel, the exterior panel, and a seam of the plurality of seams; and a thermally-insulating fill material contained within the chamber.

11. The upper body garment of claim 10, wherein the thermally-insulating fill material comprises one or more of synthetic fiber and down.

12. The upper body garment of claim 10, wherein the plurality of seams are further reinforced by stitching.

13. The upper body garment of claim 8, wherein the vented-insulation section comprises less than 50% of the upper body garment's exterior surface.

14. A jacket comprising:

an insulated panel comprising a middle panel and an exterior panel joined to each other along a plurality of seams defining edges of one or more chambers of the insulated panel, wherein a plurality of exterior openings extend through one or more seams of the plurality of seams attaching the middle panel and the exterior panel of the insulated panel; and an interior panel having a plurality of interior openings that extend through the interior panel, wherein the middle panel is located between the interior panel and the exterior panel, wherein the interior panel is attached to the insulated panel along one or more locations, wherein the interior panel and the insulated panel are spaced apart at an area where the interior panel and the insulated panel are not attached to each other, wherein at least a first portion of the plurality of interior openings of the interior panel are offset from at least a second portion of the plurality of exterior openings of the insulated panel, and wherein at least one indirect passage fluidly connects the first portion of the plurality of exterior openings and the second portion of the plurality of exterior openings.

15. The jacket of claim 14, wherein each of the plurality of seams comprises a seam width that extends between a first seam edge and a second seam edge, wherein each of the plurality of exterior openings is positioned between the first seam edge and the second seam edge.

16. The jacket of claim 14, wherein the one or more chambers contain one or more of synthetic fill and down.

17. The jacket of claim 14, wherein the exterior panel, the middle panel, and the interior panel comprise a knitted or woven construction.

18. The jacket of claim 14, wherein the plurality of exterior openings are positioned intermittently along the one or more seams of the plurality of seams.

19. The jacket of claim 14, wherein one or more of the plurality of exterior openings and one or more of the plurality of interior openings have different sizes.

20. The jacket of claim 14, wherein one or more of the plurality of exterior openings and one or more of the plurality of interior openings have different shapes.

* * * * *